US009714199B2

(12) United States Patent
Meeker et al.

(10) Patent No.: US 9,714,199 B2
(45) Date of Patent: Jul. 25, 2017

(54) CONCEALED AMALGAMATED EXPLOSIVE NEUTRALIZER AND METHOD OF MANUFACTURE

(71) Applicant: I P Creations Limited, Surrey (GB)

(72) Inventors: Daniel Hill Meeker, Fort Worth, TX (US); Benjamin John Green, Surrey (GB)

(73) Assignee: I P CREATIONS LIMITED, Surrey (GB)

( * ) Notice: Subject to any disclaimer, the term of this patent is extended or adjusted under 35 U.S.C. 154(b) by 0 days.

(21) Appl. No.: 14/857,061

(22) Filed: Sep. 17, 2015

(65) Prior Publication Data

US 2017/0081254 A1 Mar. 23, 2017

(51) Int. Cl.
*C06B 45/12* (2006.01)
*C06B 29/04* (2006.01)
(Continued)

(52) U.S. Cl.
CPC ..... *C06B 45/12* (2013.01); *C06B 29/04* (2013.01); *F41J 5/26* (2013.01); *F42D 5/04* (2013.01)

(58) Field of Classification Search
CPC .. F42D 5/04; F42B 39/14; F42B 39/20; F42B 33/00; F42B 33/06; F42B 4/00;
(Continued)

(56) References Cited

U.S. PATENT DOCUMENTS 2,368,310 A * 1/1945 Lecky ..... F42C 15/28 102/205
3,327,628 A 6/1967 Loprest
(Continued)

FOREIGN PATENT DOCUMENTS

CN 101450881 6/2009
CN 101838172 9/2010
(Continued)

OTHER PUBLICATIONS

Patel, et al., "In-Situ Landmine Neutralization by Chemical versus Thermal Initiation Deminer Preferences," U. S. Army Communications—Electronics Research, Development, and Engineering Center, 2006, 7 pages, Fort Belvoir, VA. http://www.dtic.mil/dtic/tr/fulltext/u2/a458418.pdf.
(Continued)

*Primary Examiner* — James S Bergin
(74) *Attorney, Agent, or Firm* — Schultz & Associates, P.C.

(57) ABSTRACT

A concealed amalgamated neutralizer covertly combines neutralizer material comprised of various combinations of inert materials such as calcium carbonate or silicates with common explosive material for the prevention of malicious use of the explosive material in improvised explosive devices. The concealed amalgamated neutralizer device may vary in shape, size, and color and is therefore adaptable to varying methods of containment typified by common pyrotechnic products. The neutralizer material mimics the explosive material of the pyrotechnic products without detection. Upon disassembly of a concealed amalgamated neutralizer device, the neutralizer material is mixed with and neutralizes the explosive material rendering the explosive material useless as a component for an improvised explosive device.

6 Claims, 21 Drawing Sheets

(51) Int. Cl.
*F41J 5/26* (2006.01)
*F42D 5/04* (2006.01)

(58) Field of Classification Search
CPC ..... F42B 4/02; C06B 21/0091; C06B 45/12; C06B 29/04; F41J 5/24; F41J 5/26
USPC ..... 102/335, 402, 426, 481, 293; 86/50; 149/14, 108.8, 124; 89/1.13
See application file for complete search history.

(56) References Cited

U.S. PATENT DOCUMENTS 3,421,441 A * 1/1969 Mardarello ..... F42C 1/10 102/204
3,738,276 A 6/1973 Picard et al.
3,774,541 A * 11/1973 Bratton ..... C06C 5/06 102/221
4,270,435 A * 6/1981 Hurst ..... C06B 21/0091 149/33
4,372,210 A * 2/1983 Shaffer ..... C06C 7/00 102/204
4,404,911 A * 9/1983 Bell ..... F42C 15/38 102/200
4,426,932 A * 1/1984 Bell ..... F42C 15/38 102/200
6,405,626 B1 6/2002 Bureaux et al.
7,299,735 B2 11/2007 Alford
7,690,287 B2 4/2010 Maegerlein et al.
7,927,437 B2 4/2011 Gangopadhyay et al.
8,273,197 B2 9/2012 Rostlund
8,308,879 B2 11/2012 Runemard et al.
8,505,427 B2 8/2013 Wilson et al.
8,585,841 B2 * 11/2013 Lubbe ..... C06B 21/005 149/108.2
8,671,841 B2 3/2014 Raquin et al.
2002/0117071 A1 * 8/2002 Kaliszewski ..... C06B 33/04 102/335
2010/0275802 A1 * 11/2010 Green ..... C06B 23/004 102/335
2011/0124945 A1 5/2011 Smylie et al.
2014/0170300 A1 * 6/2014 Green ..... F41J 5/14 427/8

FOREIGN PATENT DOCUMENTS

CN 102838434 12/2012
GB 2227816 8/1990
JP 2005273971 10/2005

OTHER PUBLICATIONS

U.S. Chemical Safety and Hazard Investigation Board, "Investigation Report: Donaldson Enterprises, Inc. Fireworks Disposal Explosion and Fire," Report No. 2011-06-I-HI, Jan. 2013, pp. 1-91. http://www.csb.gov/assets/1/19/DEI_Final_01172013.pdf.

* cited by examiner

METHOD USING SEPARATION BARRIER

METHOD USING IMPLANTED SPHERE

METHOD USING COVERED SPHERE

METHOD USING SUBSTRATE

METHOD FOR AMMUNITION

METHOD FOR ROMAN CANDLE

METHOD FOR ROLLING SOLIDIFIED MATERIAL

METHOD FOR ROLLING SLURRIES APPLIED TO PAPER

METHOD USING SHELL CASE

CONCEALED AMALGAMATED EXPLOSIVE NEUTRALIZER AND METHOD OF MANUFACTURE

FIELD OF THE DISCLOSURE

The present disclosure relates to neutralization of explosive materials contained in explosives and pyrotechnics. In particular, the disclosure relates to devices and methods for rendering pyrotechnics and ammunition inert or less effective.

BACKGROUND

The current worldwide political climate has produced many terrorist and anti-establishment factions that are motivated to create explosive devices from commonly available consumer products. For example, roadside or improvised explosive devices known as IEDs have been encountered in Afghanistan and in Iraq by the U.S. military and in Boston by local police.

A common practice used in constructing an IED involves the acquisition and disassembly of easily acquired consumer grade explosive products such as fireworks or small arms ammunition. The products are disassembled, yielding explosive material, e.g., black powder or other incendiary material. The explosive material is then combined with projectiles such as nails or broken glass and encased in a rigid container such as an aluminum cooking pot. The results are easily concealed and a deadly combination that is both inexpensive and effective.

Consumer grade explosive products contain various explosive materials. For example, gunpowder is a very common chemical explosive and comes in two basic forms, modern, smokeless gunpowder and traditional, black powder gunpowder. Black powder is a mixture of sulfur, charcoal, and potassium nitrate (saltpeter). The sulfur and charcoal act as fuels, and the saltpeter is an oxidizer. The standard composition for gunpowder is about 75% potassium nitrate, about 15% charcoal, and about 10%, sulfur (proportions by weight). The ratios can be altered somewhat depending on the purpose of the powder. For instance, power grades of gunpowder, unsuitable for use in firearms but adequate for blasting rock in quarrying operations, have proportions of about 70% nitrate, about 14% charcoal, and about 16% sulfur. Some blasting powder may be made with cheaper sodium nitrate substituted for potassium nitrate and proportions may be as low as about 40% nitrate, about 30% charcoal, and about 30% sulfur.

Most pyrotechnic compositions and explosive materials can be neutralized when mixed with an appropriate combination of inert materials, slowing the burn rate of the explosive material to a non-explosive level that effectively neutralizes the explosive material and renders the explosive material useless for an improvised explosive device.

The prior art addresses the neutralization of explosive devices. However, none of the prior art devices or methods is completely satisfactory in neutralizing explosive materials in consumer products.

For example, U.S. Pat. No. 7,690,287 to Maegerlein, et al. provides a neutralizing assembly for inhibiting operation of an explosive device. The neutralizing assembly will interrupt the function of the explosive device only when the explosive device is misused. The neutralizing assembly includes an interior chamber with a rupturable barrier containing disabling material. The rupturable barrier separates the disabling material from the explosive material. Upon misuse of the device, the rupturable barrier breaks and the disabling material is released from the interior chamber to disable the explosive material.

U.S. Pat. No. 3,738,276 to Picard, et al. discloses a halocarbon gel for stabilizing an explosive material during transport. In use, flexible bags are prepared which contain the explosive material mixed with a desensitizing substance. The bags are placed in a protective gel. The gel prevents the desensitizing substance from evaporating through the flexible bags. When the transport is complete, the bags are removed from the gel. Once the bags are removed from the gel, the desensitizing substance evaporates, thus "arming" the explosive material.

U.S. Patent Publication No. 2011/0124945 to Smylie, et al. discloses a cartridge that is adapted to achieve deactivation of an explosive composition. In Smylie, the explosive composition and the chemical deactivating agent are held in separate chambers of the cartridge separated by a wall. Upon activation, the wall is breached and the deactivating agent and the explosive composition are allowed to mix, thereby rendering the explosive composition inert.

It is, therefore, an object of this disclosure to provide a design for and method of manufacture of products which include an undetectable neutralizing agent that automatically and effectively neutralizes an explosive material upon disassembly.

SUMMARY OF THE DISCLOSURE

A concealed amalgamated neutralizer (CAN) is disclosed for the prevention of malicious conversion of consumer fireworks, ammunition, and other pyrotechnic products into dangerous explosive devices, such as an IED.

In a preferred embodiment, a method of manufacture is provided whereby neutralizer material is undetectably situated adjacent to explosive material. The neutralizer material is chosen from various combinations of inert materials such as calcium carbonate, silica, or other inert materials combined with complimentary inert bonding and pigmentation chemicals. The neutralizer material is chosen and modified to mimic the physical characteristics (grain size, density, color) of the explosive material so that when placed side by side with the explosive material, the two components are practically indistinguishable and inseparable.

In one embodiment, the neutralizer material may be a combination of pigmented inert granular constituents. In another embodiment, the neutralizer material may be a liquid or viscous slurry in combination with a source binder and capable of drying into a compact solid.

In another embodiment, a cylindrical design is provided, which positions the explosive material adjacent the neutralizer material along a common central axis. The physical position and/or ratio of the neutralizer material relative to the explosive material can vary to change the extent of the neutralization.

In one embodiment, a temporary build container is provided in the form of a "tube within a tube." A dry granular explosive material is introduced into the interstitial space between the tubes but excluded from the inner tube. A dry granular neutralizer material of similar color, density, size and texture as the explosive material is then introduced in the inner tube. The inner tube is then removed, allowing the explosive material to contact, but not mix with, the neutralizer material at a boundary interface. The resulting solid cylindrical shape is then packed and sealed, preserving the respective positions of the two components and the boundary interface.

In another embodiment, a spherically shaped device is provided. The neutralizer materials and explosive materials may each be hemispherical and placed "side-by-side." Temporary physical barriers may be used to separate the components, which are removed during manufacture to create a final product.

In another embodiment of the invention using wet materials, a "layered" product is provided fixed to a substrate.

In each case, the neutralizer material is placed in direct physical contact with the explosive material. The neutralizer material is physically indiscernible from the explosive material, and so the boundary interface between the two is very difficult or impossible to distinguish. Upon disassembly of the product, the neutralizer material is physically mixed with the explosive material, resulting in a combined material that is inert and useless as an explosive.

BRIEF DESCRIPTION OF THE DRAWINGS

The disclosed embodiments will be described with reference to the accompanying drawings.

DETAILED DESCRIPTION

Figure 1A:
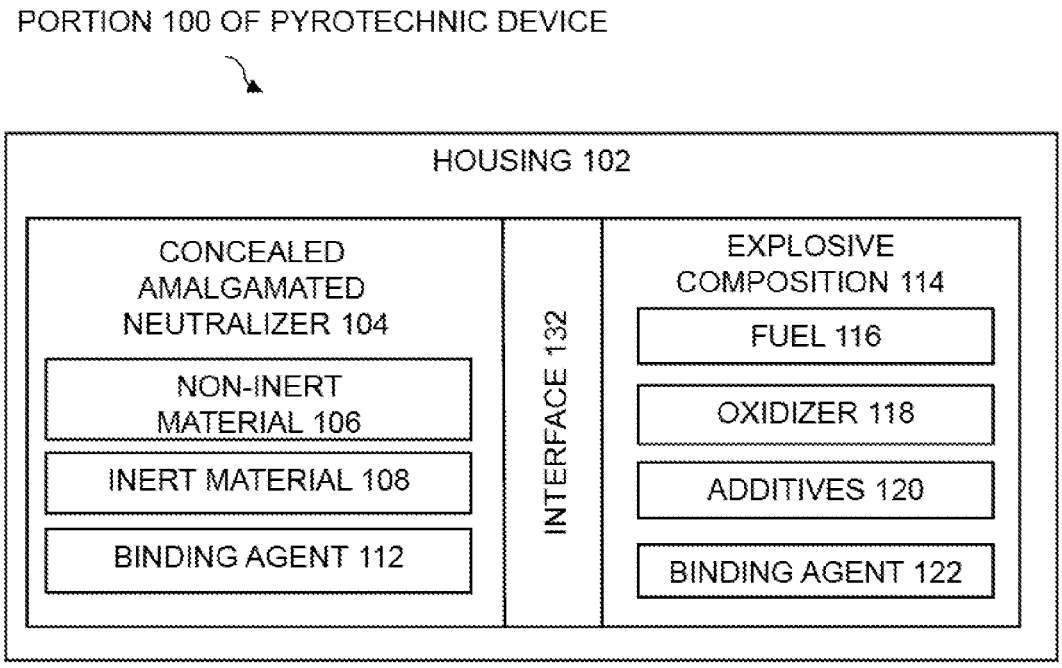
FIG. 1A is a schematic diagram of a portion of a pyrotechnic device in accordance with a preferred embodiment of this disclosure.

Referring to FIG. 1A, portion 100 of a pyrotechnic or explosive device is shown that includes concealed amalgamated neutralizer 104 to prevent the use of explosive composition 114 in other devices. Portion 100 comprises housing 102, which acts to enclose and/or support concealed amalgamated neutralizer 104 and explosive composition 114. Concealed amalgamated neutralizer 104 and explosive composition 114 are juxtaposed with or adjacent to each other. Interface 132 is an indiscernible boundary interface between concealed amalgamated neutralizer 104 and explosive composition 114 and is where concealed amalgamated neutralizer 104 touches explosive composition 114. Example pyrotechnic devices that comprise portion 100 include ammunition (such as shotgun shell 1000 of FIG. 10), fireworks (such as Roman candle 1200 of FIG. 12), and other explosive devices (such as a training target comprising the devices of FIGS. 8A, 8B and 18 and percussion caps).

Concealed amalgamated neutralizer 104 is a composition having a color and grain size that is indiscernible from the color and grain size of explosive composition 114. When mixed sufficiently with explosive composition 114, explosive power of the resulting mixture is reduced as compared to the explosive power of explosive composition 114 so as to prevent the use of explosive composition 114 outside of housing 102. Concealed amalgamated neutralizer 104 comprises non-inert material 106, inert material 108, and binding agent 112. Concealed amalgamated neutralizer 104 may be formed from a slurry, such as neutralizer slurry 124 of FIG. 1B.

In alternative embodiments, concealed amalgamated neutralizer 104 is formed without being processed from a neutralizer slurry. As an example, concealed amalgamated neutralizer 104 may be formed from a dry powder.

Materials used as non-inert material 106 include aluminum and may optionally comprise or form a pigment. Non-inert material 106 may include materials similar to fuel 116 of explosive composition 114. Non-inert material 106 alters the fuel to oxidizer ratio of explosive composition 114 and/or provides different burn characteristics so as to reduce the explosiveness of explosive composition 114 when explosive composition 114 is combined with concealed amalgamated neutralizer 104 outside of housing 102.

Materials used in inert material 108 include magnesium silicate and chalk and may optionally comprise or form a pigment. Inert material 108 does not burn or explode and acts to reduce the explosiveness of explosive composition 114 when explosive composition 114 is combined with concealed amalgamated neutralizer 104 outside of housing 102.

Materials used as binding agent 112 of concealed amalgamated neutralizer 104 include cellulose and shellac and also include materials similar to materials used as binding agent 122 of explosive composition 114. Binding agent 112 acts to bind the components of concealed amalgamated neutralizer 104 together and prevent the components of concealed amalgamated neutralizer 104 from mixing with explosive composition 114 while concealed amalgamated neutralizer 104 and explosive composition 114 are contained within the pyrotechnic device comprising portion 100.

Figure 1B:
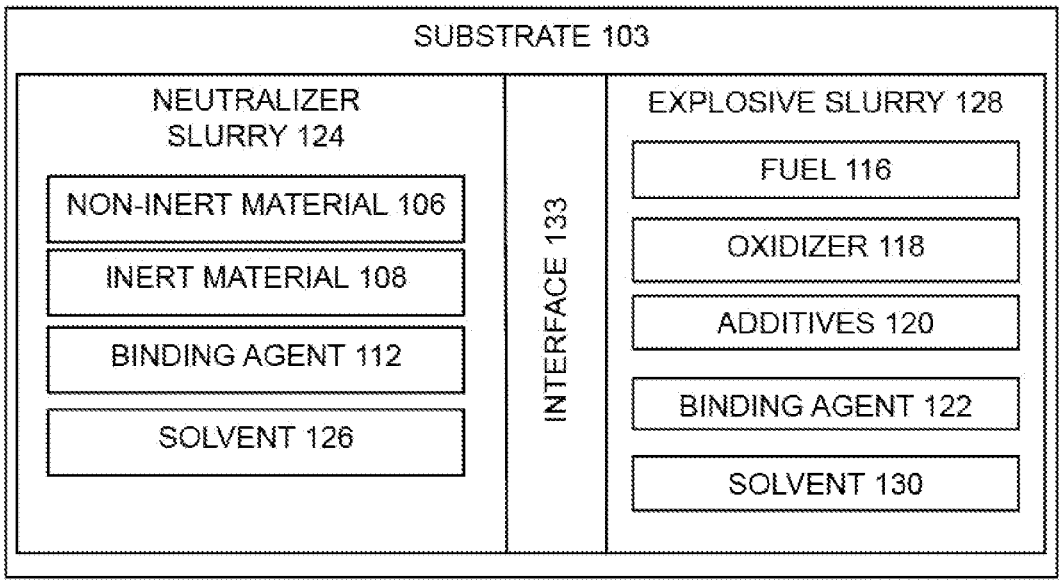
FIG. 1B is a schematic diagram of a portion of a pyrotechnic device in accordance with a preferred embodiment of this disclosure.

Referring to FIG. 1B, a substrate 103 may also be used to support various embodiments where a liquid binder is necessary. Neutralizer slurry 124 and explosive slurry 128 are formed on top of substrate 103. Interface 133 is an indiscernible boundary interface between neutralizer slurry 124 and explosive slurry 128. Neutralizer slurry 124 and explosive slurry 128 are juxtaposed with or adjacent to each other and touch each other at interface 133.

Neutralizer slurry 124 is used to form concealed amalgamated neutralizer 104. Neutralizer slurry 124 includes non-inert material 106, inert material 108, and binding agent 112. Neutralizer slurry 124 also includes solvent 126. Once positioned with respect to substrate 103, neutralizer slurry 124 is allowed to solidify by withdrawal of solvent 126, e.g., via vaporization, to form concealed amalgamated neutralizer 104 as a solid or to give concealed amalgamated neutralizer 104 a more solid-like form.

Materials used as solvent 126 include methyl ethyl ketone (MEK), cellulose thinners, isopropanol, alcohol, water, hydrogen peroxide, liquefied petroleum gas (LPG), and liquid nitrogen. Solvent 126 dissolves the other components of neutralizer slurry 124 and allows neutralizer slurry 124 to be processed in a more liquid-like fashion as compared to concealed amalgamated neutralizer 104.

Explosive composition 114 is an explosive material, also known as a pyrotechnic composition, comprising one or more fuels 116, oxidizers 118, and additives 120, and binding agents 122. Fuels 116 and oxidizers 118 interact chemically to release energy, additives 120 add additional properties, and binding agents 122 bind explosive composition 114 together. Explosive composition 114 is formed from explosive slurry 128.

In alternative embodiments, explosive composition 114 is formed without being processed from explosive slurry 128. As an example, explosive composition 114 may be formed from a dry powder.

Materials used as fuel 116 include: metals, metal hydrides, metal carbides, metalloids, non-metallic inorganics, carbon based compounds, organic chemicals, and organic polymers and resins. Metal fuels include: aluminum, magnesium, magnalium, iron, steel, zirconium, titanium, ferrotitanium, ferrosilicon, manganese, zinc, copper, brass, tungsten, zirconium-nickel alloy. Metal hydride fuels include: titanium(II) hydride, zirconium(II) hydride, aluminum hydride, and decaborane. Metal carbides used as fuels include zirconium carbide. Metalloids used as fuels include: silicon, boron, and antimony. Non-metallic inorganic fuels include: sulfur, red phosphorus, white phosphorus, calcium silicide, antimony trisulfide, arsenic sulfide (realgar), phosphorus trisulfide, calcium phosphide, and potassium thiocyanate. Carbon based fuels include: carbon, charcoal, graphite, carbon black, asphaltum, and wood flour. Organic chemical fuels include: sodium benzoate, sodium salicylate, gallic acid, potassium picrate, terephthalic acid, hexamine, anthracene, naphthalene, lactose, dextrose, sucrose, sorbitol, dextrin, stearin, stearic acid, and hexachloroethane. Organic polymer and resin fuels include: fluoropolymers (such as Teflon and Viton), hydroxyl-terminated polybutadiene (HTPB), carboxyl-terminated polybutadiene (CTPB), polybutadiene acrylonitrile (PBAN), polysulfide, polyurethane, polyisobutylene, nitrocellulose, polyethylene, polyvinyl chloride, polyvinylidene chloride, shellac, and accroides resin (red gum).

Materials used as oxidizers 118 include: perchlorates, chlorates, nitrates, permanganates, chromates, oxides and peroxides, sulfates, organic chemicals, and others. Perchlorate oxidizers include: potassium perchlorate, ammonium perchlorate, and nitronium perchlorate. Chlorate oxidizers include: potassium chlorate, barium chlorate, and sodium chlorate. Nitrates include: potassium nitrate, sodium nitrate, calcium nitrate, ammonium nitrate, barium nitrate, strontium nitrate, and cesium nitrate. Permanganate oxidizers include: potassium permanganate and ammonium permanganate. Chromate oxidizers include: barium chromate, lead chromate, and potassium dichromate. Oxide and peroxide oxidizers include: barium peroxide, strontium peroxide, lead tetroxide, lead dioxide, bismuth trioxide, iron(II) oxide, iron(III) oxide, manganese(IV) oxide, chromium(III) oxide, and tin(IV) oxide. Sulfate oxidizers include: barium sulfate, calcium sulfate, potassium sulfate, sodium sulfate, and strontium sulfate. Organic oxidizers include: guanidine nitrate, hexanitroethane, cyclotrimethylene trinitranmine, and cyclotetramethylene tetranitramine. Other oxidizers include: sulfur, Teflon, and boron.

Materials used as additives 120 include materials that act as: coolants, flame suppressants, opacifiers, colorants, chlorine donors, catalysts, stabilizers, anticaking agents, plasticizers, curing and crosslinking agents, and bonding agents. Coolants include: diatomaceous earth, alumina, silica, magnesium oxide, carbonates including strontium carbonate, and oximide. Flame suppressants include: potassium nitrate and potassium sulfate. Opacifiers include carbon black and graphite. Colorants include: salts of metals (including barium, strontium, calcium, sodium, and copper), copper metal, and copper acetoarsenite with potassium perchlorate. Chlorine donors include: polyvinyl chloride, polyvinylidene chloride, vinylidene chloride, chlorinated paraffins, chlorinated rubber, hexachloroethane, hexachlorobenzene, and other organochlorides and inorganic chlorides (e.g., ammonium chloride, mercurous chloride), as well as perchlorates and chlorates. Catalysts include: ammonium dichromate, iron(III) oxide, hydrated ferric oxide, manganese dioxide, potassium dichromate, copper chromite, lead salicylate, lead stearate, lead 2-ethylhexoate, copper salicylate, copper stearate, lithium fluoride, n-butyl ferrocene, di-n-butyl ferrocene. Stabilizers include: carbonates (e.g., sodium, calcium, or barium carbonate), alkaline materials, boric acid, organic nitrated amines (such as 2-nitrodiphenylamine), petroleum jelly, castor oil, linseed oil, ethyl centralite, and 2-nitrodiphenylamine. Anticaking agents include: fumed silica, graphite, and magnesium carbonate. Plasticizers: include dioctyl adipate, isodecyl pelargonate, and dioctyl phthalate as well as other energetic materials such as: nitroglycerine, butanetriol trinitrate, dinitrotoluene, trimethylolethane trinitrate, diethylene glycol dinitrate, triethylene glycol dinitrate, bis(2,2-dinitropropyl)formal, bis(2,2-dinitropropyl)acetal, 2,2,2-trinitroethyl 2-nitroxyethyl ether, and others. Curing and crosslinking agents include: paraquinone dioxime, toluene-2,4-diisocyanate, tris(1-(2-methyl) aziridinyl) phosphine oxide, N,N,O-tri(1,2-epoxy propyl)-4-aminophenol, and isophorone diisocyanate. Bonding agents include tris(1-(2-methyl) azirinidyl) phosphine oxide and triethanolamine.

Materials used as binding agents 122 include: gums, resins and polymers, such as: acacia gum, red gum, guar gum, copal, cellulose, carboxymethyl cellulose, nitrocellulose, rice starch, cornstarch, shellac, dextrin, hydroxyl-terminated polybutadiene (HTPB), polybutadiene acrylonitrile (PBAN), polyethylene, and polyvinyl chloride (PVC).

Explosive slurry 128 is used to form explosive composition 114. Explosive slurry 128 includes fuel 116, oxidizer 118, additives 120, and binding agent 122. Explosive slurry 128 also includes solvent 130. Once positioned with respect to housing 102, explosive slurry 128 is allowed to solidify by withdrawal of solvent 130, e.g., via vaporization, to form explosive slurry 128 as a solid or to give explosive slurry 128 more solid-like form.

Materials used as solvent 130 include methyl ethyl ketone (MEK), cellulose thinners, isopropanol, alcohol, water, and hydrogen peroxide. Solvent 130 dissolves the other components of explosive slurry 128 and allows explosive slurry 128 to be processed in a more liquid-like fashion as compared to explosive composition 114.

Table 1 below shows typical components of dry granular explosive materials, dry neutralizer materials, coloring agents, and ratios required to neutralize the explosive materials in several preferred embodiments. The ratios indicated are by weight, but similar ratios may also be made by volume. The percentage composition of the explosive materials can vary by as much as plus or minus 15%. The percentage composition of the neutralizer materials can vary by as much as plus or minus 15%. The composition ratios can vary by as much as plus or minus 25%.

TABLE 1

| Dry Explosive Materials | Dry Neutralizer Materials | Coloring Agents | DEM:DIM (by weight) |
|---|---|---|---|
| 70% potassium chlorate<br>30% aluminum | 65% magnesium silicate<br>30% aluminum<br>5% ackroyd resin | Aluminum | 3:2 |
| 75% potassium nitrate<br>15% charcoal<br>10% sulfur | Silica | Carbon slurry | 3:1 |
| 70% potassium nitrate<br>14% charcoal<br>16% sulfur | Silica | Carbon slurry | 3:1 |
| 40% sodium nitrate<br>30% charcoal<br>30% sulfur | Chalk | Carbon black | 3:2 |
| 75% potassium nitrate<br>19% carbon<br>6% sulfur | Barium | Lamp black | 6:5 |

Table 2 below shows typical components of explosive materials, neutralizer materials, pigmentation, solvents, and ratios. The percentage composition of the explosive materials can vary by as much as plus or minus 15%. The percentage composition of the neutralizer materials can vary by as much as plus or minus 15%. The composition ratios can vary by as much as plus or minus 25%.

TABLE 2

| Explosive Materials | Neutralizer Materials | Pigmentation | Solvents | EM:IM:Sol (by weight) |
|---|---|---|---|---|
| 75% potassium nitrate<br>15% charcoal<br>10% sulfur | Silica | Carbon black | Alcohol | 3:1:1 |
| 70% potassium nitrate<br>14% charcoal<br>16% sulfur | Chalk | Lamp black | Water | 3:2:2 |
| 40% sodium nitrate<br>30% charcoal<br>30% sulfur | Barium | Aluminum pigment (ultramarine) | Isopropanol | 6:5:4 |
| 75% potassium nitrate<br>19% carbon<br>6% sulfur | Saw dust | Vine black | Liquid nitrogen | 11:9:9 |

Tables 3-5 below show typical components of neutralizers, solvents, pigments, and explosive compounds, any of which may be used in pyrotechnic devices in accordance with this disclosure. Table 3 below includes a list of neutralizers and solvents, any of which may be used in pyrotechnic devices.

TABLE 3

| Neutralizers | Solvents |
|---|---|
| Talcum | Methyl ethyl ketone (MEK) |
| Chaulk | Cellulose thinners |
| Barrium | Isopropanol |
| Manganese | Water |
| Aluminum | Alcohol |
| Silica | Hyrogen peroxide |
| Saw dust | Liquefied petroleum gas |
| Calcium carbonate | Liquid nitrogen |
| Barite | |
| Potters clay | |

Table 4 below shows a list of pigments, any of which may be used in pyrotechnic devices. A pigment that is used in portion 100 of pyrotechnic device may form part of non-inert material 106 or part of inert material 108, depending on the chemical composition of the pigment. When a pigment is used to tint concealed amalgamated neutralizer 104, a sufficient amount is used to coat and color the granules formed from non-inert material 106 and inert material 108 within concealed amalgamated neutralizer 104. The amount or proportion of pigment may vary depending on the grain size of the granules formed from non-inert material 106 and inert material 108 within concealed amalgamated neutralizer 104. The pigment may be introduced to concealed amalgamated neutralizer 104 in the form of a dye. Similarly, the granules of the inert materials may be washed with a pigment or dye for a time sufficient to change their color to approximate the color of the granules of the non-inert material. The grainsize of the pigmented inert material can be controlled by sifting with an appropriate wire mesh or other method as known in the art. The mesh size is chosen to approximate the size of the non-inert material.

TABLE 4

| Pigments |
|---|
| Aluminum pigments: ultramarine violet, ultramarine |
| Antimony pigments: antimony white |
| Arsenic pigments: orpiment natural monoclinic arsenic sulfide ($As_2S_3$) |
| Barium pigments: barium sulfate |
| Biological pigments: alizarin, alizarin crimson, gamboge, cochineal red, rose madder, indigo, Indian yellow, Tyrian purple |
| Cadmium pigments: cadmium yellow, cadmium red, cadmium green, cadmium orange, cadmium sulfoselenide (CdSe) |
| Carbon pigments: carbon black, ivory black (bone char), vine black, lamp black, India ink |
| Chromium pigments: chrome green, viridian, chrome yellow, chrome orange |
| Clay earth pigments (iron oxides): yellow ochre, raw sienna, burnt sienna, raw umber, burnt umber |
| Cobalt pigments: cobalt violet, cobalt blue, cerulean blue, aureolin (cobalt yellow) |
| Copper pigments: Azurite, Han purple, Han blue, Egyptian blue, Malachite, Paris green, Scheele's Green, Phthalocyanine Blue BN, Phthalocyanine Green G, verdigris, viridian |
| Iron pigments: Prussian blue, yellow ochre, iron black |
| Iron oxide pigments: sanguine, caput mortuum, oxide red, red ochre, Venetian red, burnt sienna |
| Lead pigments: lead white, cremnitz white, Naples yellow, red lead |
| Manganese pigments: manganese violet |
| Mercury pigments: vermilion |
| Organic pigments: quinacridone, magenta, phthalo green, phthalo blue, pigment red 170, diarylide yellow |
| Tin pigments: mosaic gold |
| Titanium pigments: titanium yellow, titanium beige, titanium white, titanium black |
| Ultramarine pigments: ultramarine, ultramarine green shade |
| Zinc pigments: zinc white, zinc ferrite |
| India ink |

Table 5 below shows typical explosive compounds, any of which may be used in pyrotechnic devices in accordance with this disclosure. Table 5 includes the following acronyms (among others): trinitrotoluene (TNT), ammonium nitrate (AN), ammonium nitrate fuel oil (ANFO), triethylenetetramine (TETA), nitromethane (NM), penthrite (PETN), research department explosive (RDX), erythritol tetranitrate (ETN), high-velocity military explosive (HMX), polyurethane (PU), polycaprolactone (PCP), trimethylolethane trinitrate (TMETN), hydroxyl-terminated polybutadiene (HTPB), alkyl acrylate copolymer (ACM), dioctyl adipate (DOA), ammonium perchlorate (AP), nitrocellulose (NC), and isopropyl nitrate (IPN).

TABLE 5

| Explosive compounds |
|---|
| Aluminun powder (30%) + Potassium chlorate (70%) |
| Amatol (50% TNT + 50% AN) |
| Amatol (80% TNT + 20% AN) |
| Ammonium nitrate (AN + <0.5% $H_2O$) |
| ANFO (94% AN + 6% fuel oil) |
| ANNMAL (66% AN + 25% NM + 5% Al + 3% C + 1% TETA) |
| Black powder (75% $KNO_3$ + 19% C + 6% S) |
| Blasting powder |
| Chopin's Composition (10% PETN + 15% RDX + 72% ETN) |
| Composition A-5 (98% RDX + 2% stearic acid) |
| Composition B (63% RDX + 36% TNT + 1% wax) |
| Composition C-3 (78% RDX) |
| Composition C-4 (91% RDX) |
| DADNE (1,1-diamino-2,2-dinitroethene, FOX-7) |
| DDF (4,4'-Dinitro-3,3'-diazenofuroxan) |
| Diethylene glycol dinitrate (DEGDN) |
| Dinitrobenzene (DNB) |
| Erythritol tetranitrate (ETN) |
| Ethylene glycol dinitrate (EGDN) |
| Flash powder |
| Gelatin (92% NG + 7% nitrocellulose) |
| Heptanitrocubane (HNC) |
| Hexamine dinitrate (HDN) |
| Hexanitrobenzene (HNB) |
| Hexanitrostilbene (HNS) |

TABLE 5-continued

| Explosive compounds |
|---|
| Hexogen (RDX) |
| HMTD (hexamine peroxide) |
| HNIW (CL-20) |
| Hydrazine mononitrate |
| Hydromite ® 600 (AN water emulsion) |
| MEDINA (Methylene dinitroamine) |
| Mixture: 24% nitrobenzene + 76% TNM |
| Mixture: 30% nitrobenzene + 70% nitrogen tetroxide |
| Nitrocellulose (13.5% N, NC) |
| Nitroglycerin (NG) |
| Nitroguanidine |
| Nitromethane (NM) |
| Nitrourea |
| Nobel's Dynamite (75% NG + 23% diatomite) |
| Nitrotriazolon (NTO) |
| Octanitrocubane (ONC) |
| Octogen (HMX grade B) |
| Octol (80% HMX + 19% TNT + 1% DNT) |
| PBXIH-135 EB (42% HMX, 33% Al, 25% PCP-TMETN's system) |
| PBXN-109 (64% RDX, 20% Al, 16% HTPB's system) |
| PBXW-11 (96% HMX, 1% ACM, 3% DOA) |
| PBXW-126 (22% NTO, 20% RDX, 20% AP, 26% Al, 12% PU's system) |
| Penthrite (PETN) |
| Pentolite (56% PETN + 44% TNT) |
| Picric acid (TNP) |
| Plastics Gel ® (45% PETN + 45% NG + 5% DEGDN + 4% NC) |
| RISAL P (50% IPN + 28% RDX + 15% Al + 4% Mg + 1% Zr + 2% NC) |
| Semtex 1A (76% PETN + 6% RDX) |
| Tanerit Simply ® (93% granulated AN + 6% red P + 1% C) |
| acetone peroxide (TATP) |
| Tetryl |
| Tetrytol (70% tetryl + 30% TNT) |
| trinitroazetidine (TNAZ) |
| Torpex (aka HBX, 41% RDX + 40% TNT + 18% Al + 1% wax) |
| Triaminotrinitrobenzene (TATB) |
| Trinitrobenzene (TNB) |
| Trinitrotoluene (TNT) |
| Tritonal (80% TNT + 20% aluminium) |

Figure 2A:
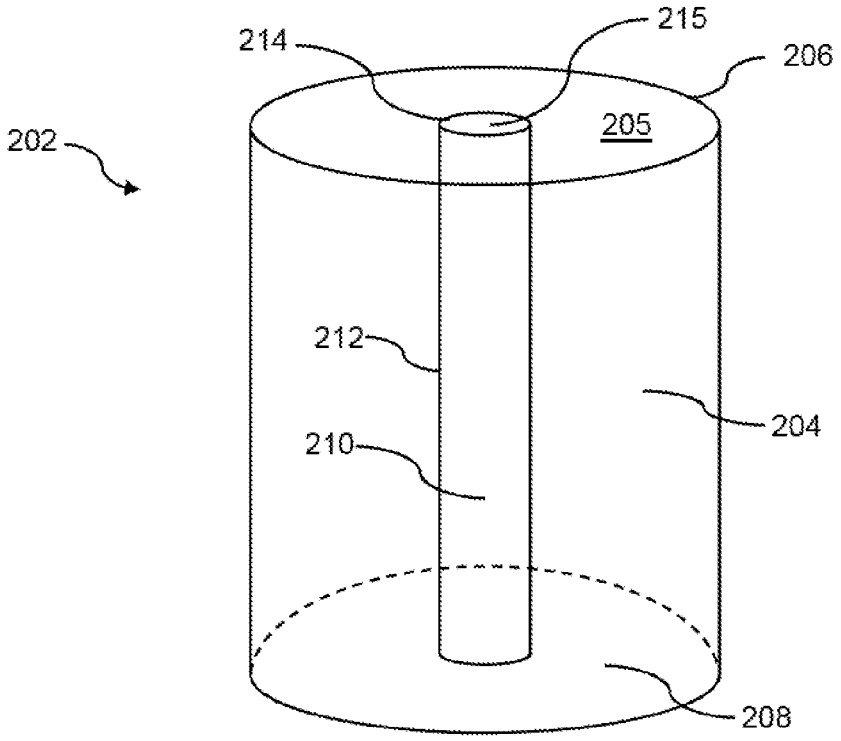
FIG. 2A is an isometric view of a tube within a tube build container.

Referring to FIG. 2A, build container 202 is shown. Build container 202 is a generally hollow cylinder having sidewall 204, open end 206, and closed end 208 defining interior space 205. In one embodiment, number 20 cardboard is used to form the ends and walls. Other structural materials such as mylar or vinyl will suffice. Build container 202 is used in a preferred method of assembling generally cylindrical shaped devices containing various combinations of dry compositions of explosive and neutralizer materials, as will be further described. Inner tube 210 is removably affixed within the interior of build container 202 by means common in the art, such as a suitably releasable adhesive. In the preferred embodiment, inner tube 210 is located co-axially with build container 202, however inner tube 210 may be positioned anywhere within interior 205. Although a single inner tube is depicted within build container 202, it will be understood that a plurality of inner tubes may be installed inside build container 202. Inner tube 210 has an exterior cylindrical shaped surface 212 and an open end 214 defining interior space 215. Neutralizer material is loaded into interior space 215, which is inside of interior space 205, and the explosive material is loaded into interior space 205 outside of interior space 215. Those skilled in the art will understand that shapes other than cylindrical may be used for inner tube 210 and/or build container 202 such as elliptical, rectangular, and triangular. It is further understood that the size of inner tube 210 relative to build container 202 can be changed depending on the ratio of neutralizer material to explosive material required to properly render the explosive material useless. Additionally, the overall volume of the assembled device may vary depending on intended use of the device.

It should be understood that the positions of the explosive and neutralizer materials could be reversed so that explosive material is loaded into interior space 215, which is inside of interior space 205, and the neutralizer material is loaded into interior space 205 outside of interior space 215. Furthermore, the relative dimensions of the build container and the inner tube organize functions of the ratio of explosive and neutralizer materials.

Figure 2B:
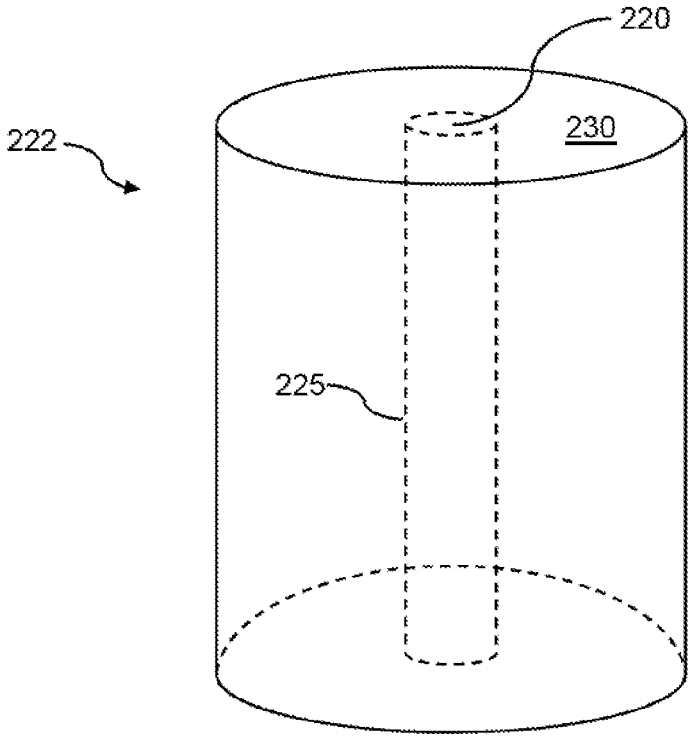
FIG. 2B is an isometric view of a preferred embodiment in cylindrical form.

FIG. 2B shows an assembled device 222 containing neutralizer material 220 and explosive material 230 separated by a boundary interface 225. Neutralizer material 220 is comprised of components that match explosive material 230 such that neutralizer material 220 is indiscernible from explosive material 230. Neutralizer material 220 is chosen to approximate the grain size and color of explosive material 230. Boundary interface 225 is where explosive material 230 contacts neutralizer material 220 within assembled device 222. Since neutralizer material 220 is indiscernible from explosive material 230, boundary interface 225 is not visible.

Figure 3A:
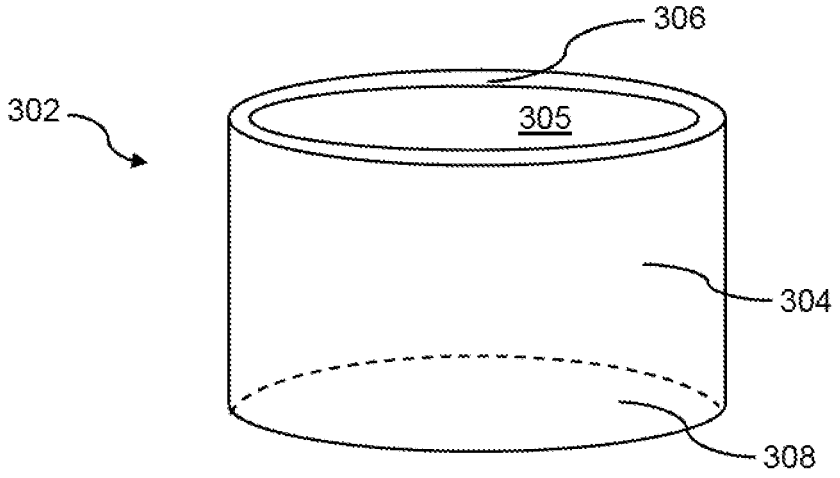
FIG. 3A is an isometric view of a cylindrical layered build container.

Referring to FIG. 3A, alternate build container 302 is shown. Build container 302 is a generally hollow cylinder having sidewall 304, open end 306, and closed end 308 defining interior space 305. Build container 302 is used for assembling generally disc shaped, layered devices.

Figure 3B:
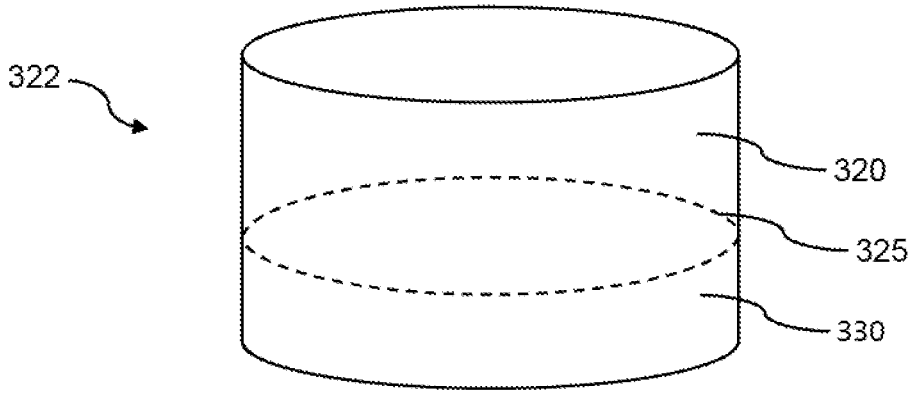
FIG. 3B is an isometric view of a preferred embodiment in layered form.

FIG. 3B shows an assembled device 322 made from build container 302 in which dry manufacture neutralizer material 320 is layered on top of explosive material 330. In an alternate embodiment, explosive material 330 is layered on top of neutralizer material 320. Explosive material 330 is separated from neutralizer material 320 by boundary interface 325.

Figure 4A:
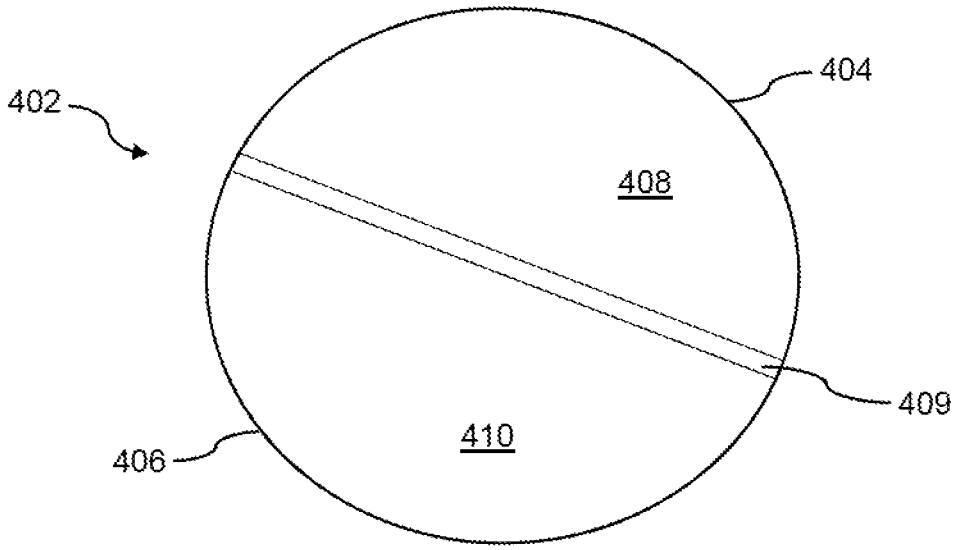
FIG. 4A is a section plan view of spherical side by side build container.

FIG. 4A shows an alternate build container 402. Build container 402 is comprised of two hollow, semi-spherical halves 404 and 406. Half 404 defines interior space 408 and half 406 defines interior space 410. A disk shaped separation barrier 409 may be affixed to either half 404 or 406 to contain the explosive material and neutralizer material during assembly.

Figure 4B:
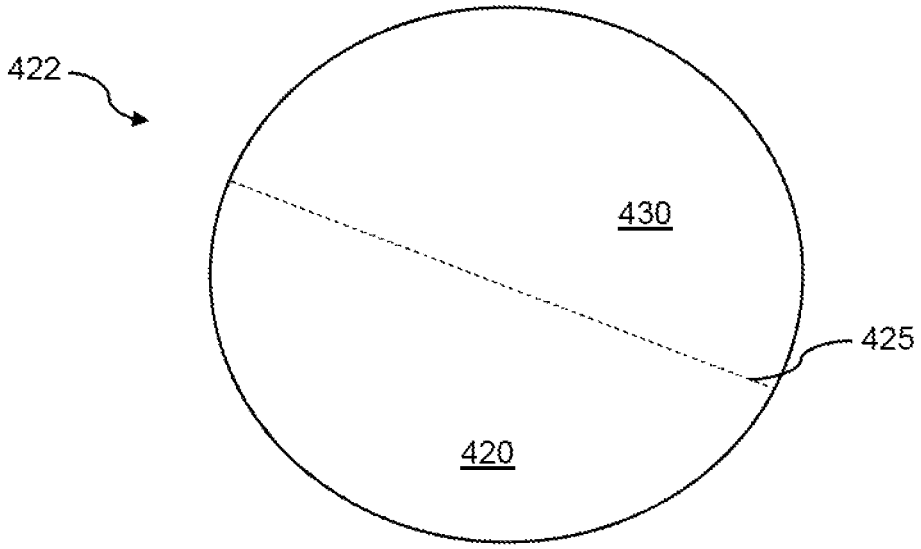
FIG. 4B is a section plan view of a preferred embodiment in spherical form.

FIG. 4B shows an assembled device 422 made from build container 402. Explosive material 430 is separated from neutralizer material 420 by boundary interface 425. Boundary interface 425 is imperceptible upon visual inspection.

Figure 4C:
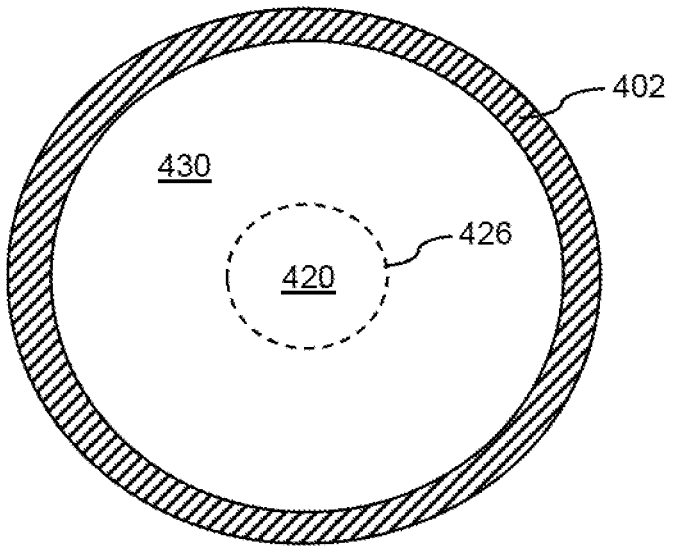
FIG. 4C is a section plan view of a spherical build container with a preferred embodiment in spherical form.

In an alternate spherical arrangement shown in FIG. 4C, build container 402 is used to create a spherical shaped device comprised of a spherical core surrounded by a larger sphere. Explosive material 430 is a hollow sphere shape including a spherical shaped core of neutralizer material 420. It should be understood by those skilled in the art that an arrangement of neutralizer material surrounding explosive material would be equally effective. Imperceptible boundary interface 426 is provided between explosive material 430 and neutralizer material 420.

For simplicity in FIGS. 1-4, detonators, primers, fuses, igniters, casings, plugs, etc. are not shown as each device may require different combinations of these elements typically found in various consumer fireworks, ammunition, and other pyrotechnic products. Some devices use other sources of ignition such as heat or impact.

Figure 5:
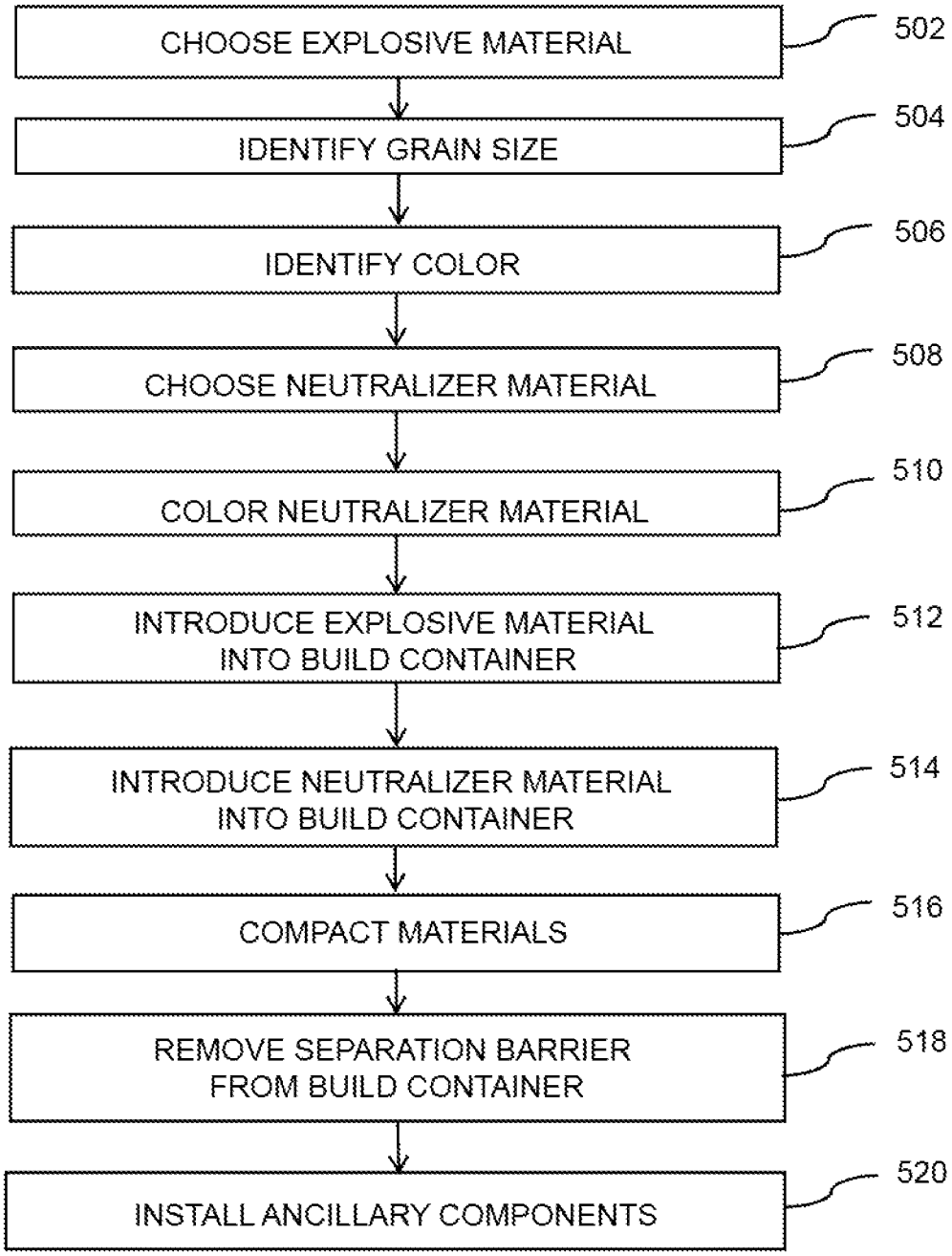
FIG. 5 is a flow chart of steps required with assembly of a preferred embodiment of this disclosure.

Referring to FIG. 5, the steps involved with constructing a device using generally dry materials are shown. At step 502, an explosive material is chosen. The proper explosive material will be chosen based on its intended use. At step 504 the grain size of the explosive material is identified. If the explosive material contains multiple components each having different grains sizes, each grain size will be identified. At step 506, the color of the explosive material is identified. At step 508, a matching neutralizer material with the identified grain size is chosen. The neutralizer material and the level of neutralization desired are chosen according to Table 1 for dry materials or Table 2 for slurries. At step 510, if the color of the neutralizer material does not match the explosive material, then the neutralizer material is colored using a pigment or dye to match the explosive material. In a different embodiment, a charcoal dye is employed to tint the neutralizer material. At step 512, the explosive material is introduced into a build container. At step 514, the neutralizer material is introduced into the build container, and if necessary, the build container is assembled. If necessary, at step 516, the materials introduced in the build container are compacted. At step 518, the separation barrier is removed from the build container. At step 520, any ancillary components required for the device, such as plugs, primers, fuses, detonators, etc., are installed and the assembled device is wrapped in appropriate casing.

Figure 6:
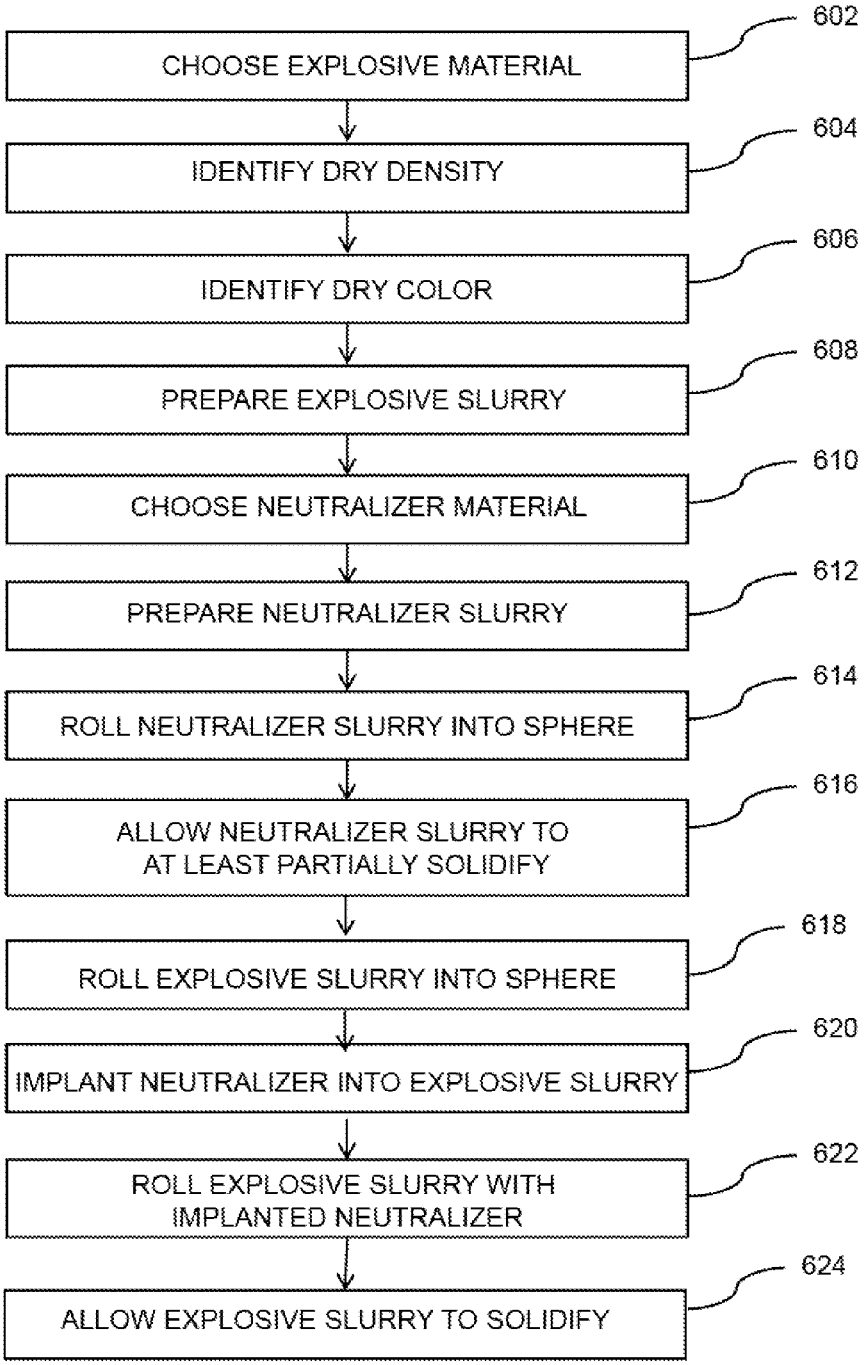
FIG. 6 is a flow chart of steps to build a spherical pyrotechnic device in accordance with a preferred embodiment of this disclosure.

Referring to FIG. 6, one or more steps involved with constructing a spherical pyrotechnic device using generally inert materials are shown. At step 602, an explosive material is chosen. The proper explosive material will be chosen based on its intended use. At step 604, the dry density of the explosive material is identified. At step 606, the color of the dried explosive material is identified. At step 608, a slurry is prepared from the explosive material and the appropriate solvent or liquid. At step 610, the neutralizer material with the identified dry density is chosen. At step 612, a neutralizer slurry is prepared using the neutralizer material and proper pigmentation and solvent.

At step 614, the neutralizer slurry is rolled into a sphere. In a preferred embodiment, the neutralizer slurry is rolled into a sphere through the use of a scoop. In one preferred embodiment, a scoop is used which is part number ZEROLL 1020 available from Centinal Restaurant Products of Indianapolis, Ind.

At step 616, the neutralizer slurry is optionally allowed to at least partially solidify so that the sphere of the neutralizer slurry will maintain its geometry during subsequent processing. At step 618, the explosive slurry is rolled into a sphere such that the volume of the sphere of the neutralizer slurry and the volume of the sphere of the explosive slurry forms a selected ratio, e.g., 2:3 or about 40% to about 60%.

At step 620, the sphere of neutralizer slurry is implanted into the sphere of the explosive slurry. The sphere of neutralizer slurry is implanted into substantially the center of the sphere of the explosive slurry to create a substantially uniform spherical explosive profile. In other embodiments, the shape and position of the neutralizer slurry within the sphere of explosive slurry is selected to create a non-uniform explosive profile that is not spherical.

At step 622, the volume of explosive slurry into which the sphere of neutralizer slurry was implanted is rolled again to reform a spherical shape. At step 624, the explosive slurry is allowed to solidify and, if it is not already solidified, the neutralizer slurry within the sphere of explosive slurry is also optionally allowed to solidify and dry. The sphere comprising the solidified explosive slurry and the neutralizer slurry may then be used to form a pyrotechnic device.

Figure 7:
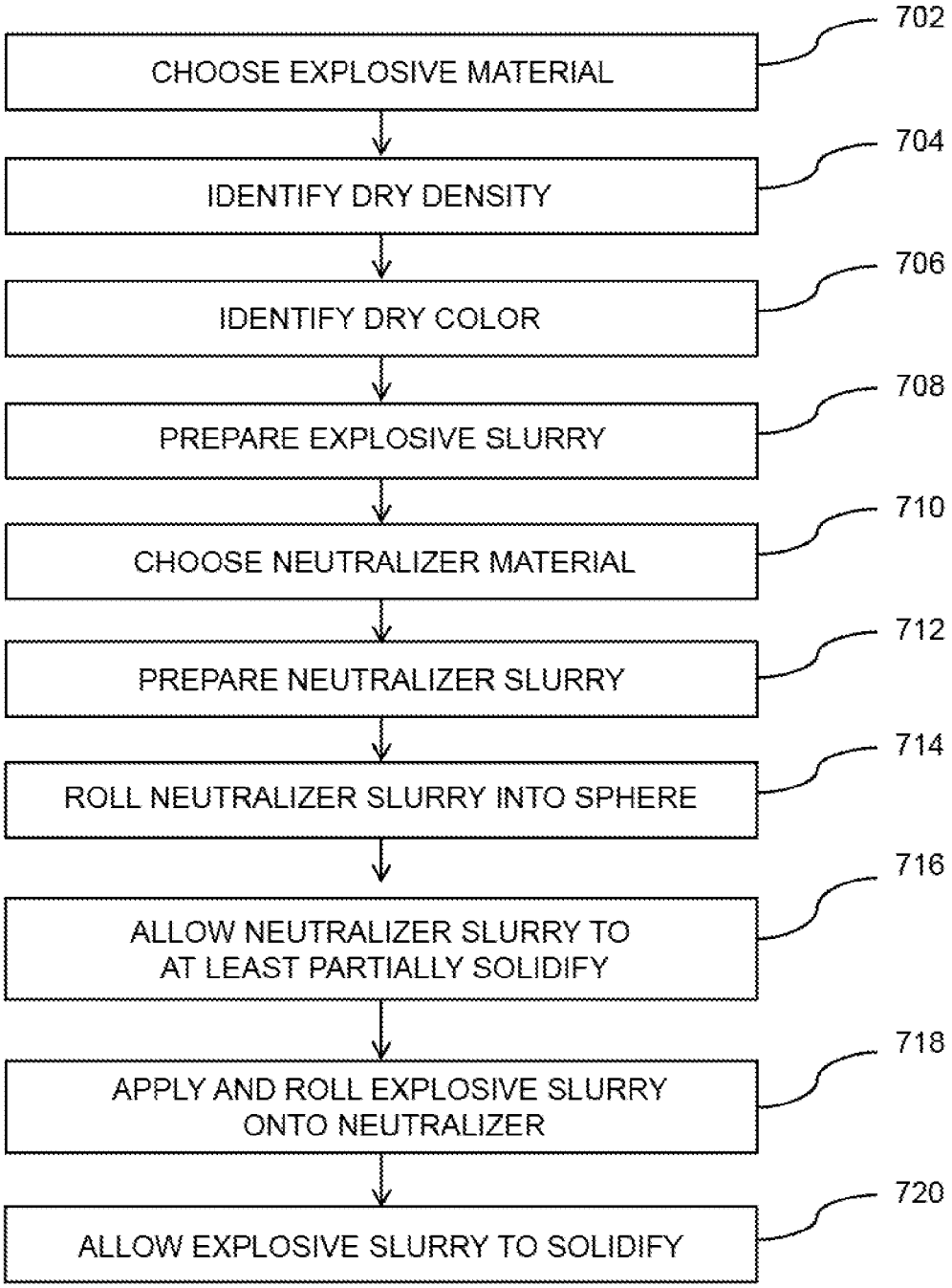
FIG. 7 is a flow chart of steps to build a spherical pyrotechnic device in accordance with a preferred embodiment of this disclosure.

Referring to FIG. 7, one or more steps involved with constructing a preferred device is shown. At step 702, an explosive material is chosen. The proper explosive material will be chosen based on its intended use. At step 704, the dry density of the explosive material is identified. At step 706, the color of the dried explosive material is identified. At step 708, a slurry is prepared from the explosive material and the appropriate solvent or liquid. At step 710, the neutralizer material with the identified dry density is chosen. At step 712, a neutralizer slurry is prepared using the neutralizer material and proper pigmentation and solvent. At step 714, the neutralizer slurry is rolled into a sphere. At step 716, the neutralizer slurry is optionally allowed to at least partially solidify so that the sphere of the neutralizer slurry will maintain its geometry during subsequent processing. At step 718, explosive slurry is applied and rolled onto the sphere of partially solidified neutralizer slurry. At step 720, the explosive slurry is allowed to solidify and, if it is not already solidified, the neutralizer slurry within the sphere of explosive slurry is also optionally allowed to solidify and dry. The sphere comprising the solidified explosive slurry and the neutralizer slurry may then be used to form a pyrotechnical device.

Figure 8A:
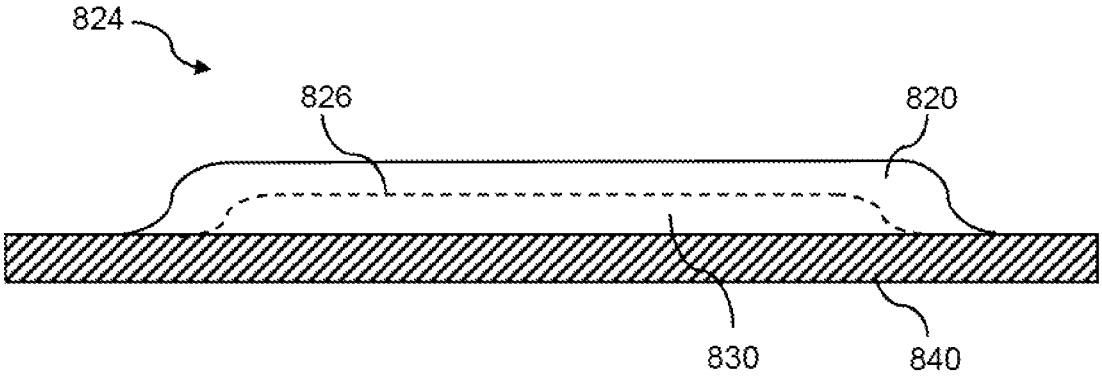
FIG. 8A is a section plan view of an alternate embodiment resulting from liquid materials.

FIG. 8A shows an alternate embodiment of device 824 constructed on substrate 840. Substrate 840 is preferably paper, but may also take the form of other planar surfaces or objects. Explosive material 830 is adhered to substrate 840. Neutralizer material 820 is adhered to both explosive material 830 and substrate 840 thereby encapsulating the explosive material and forming boundary interface 826. Device 824 is manufactured from slurry compositions of explosive materials and neutralizer materials as will be further described.

The thickness of explosive material 830 on substrate 840 is substantially uniform along the surface of substrate 840, except at the outer edges. The thickness of neutralizer material 820 on explosive material 830 and on substrate 840 is also substantially uniform, except at the outer edges. In alternative embodiments, the thicknesses may vary. For example, when device 824 embodies a target training dummy, a thickness of explosive material 830 at substantially the center of the target training dummy may be increased and a thickness of neutralizer material 820 may be reduced to retain a similar overall thickness. In this manner, a different pyrotechnic and visual effect is achieved so that a hit substantially in the center of the target training dummy is distinguishable from a hit that is not substantially in the center of the target training dummy.

Figure 8B:
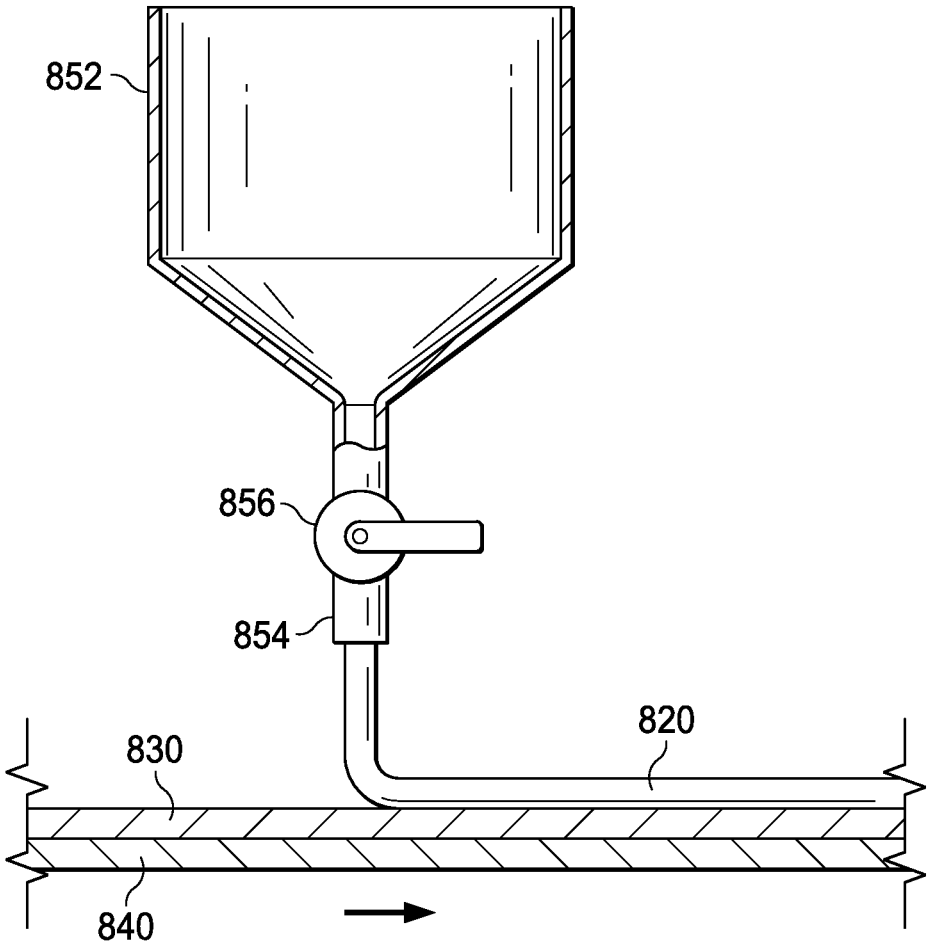
FIG. 8B is a section plan view of an alternate embodiment resulting from liquid materials as it is being made.

FIG. 8B shows an alternate embodiment of device 824 as a layer of neutralizer material 820 is being applied to explosive material 830. Neutralizer material 820 is prepared in tank or hopper 852 and then applied to explosive material 830 on substrate 840. Tank or hopper 852 includes an outlet 854 and a valve 856 at the underside of tank or hopper 852, and outlet 854 is controlled by a valve 856. The valve 856 can be adjusted to control the volume of the neutralizer slurry dispensed. One of the tank or hopper 852 or the substrate 840 is moved in a direction so that a controlled amount of neutralizer material 820 is applied to explosive material 830. In a preferred embodiment, the thickness of neutralizer material 820 is substantially the same as the thickness of explosive material 830. In alternative embodiments, the thicknesses of neutralizer material 820 and explosive material 830 may vary.

Figure 9:
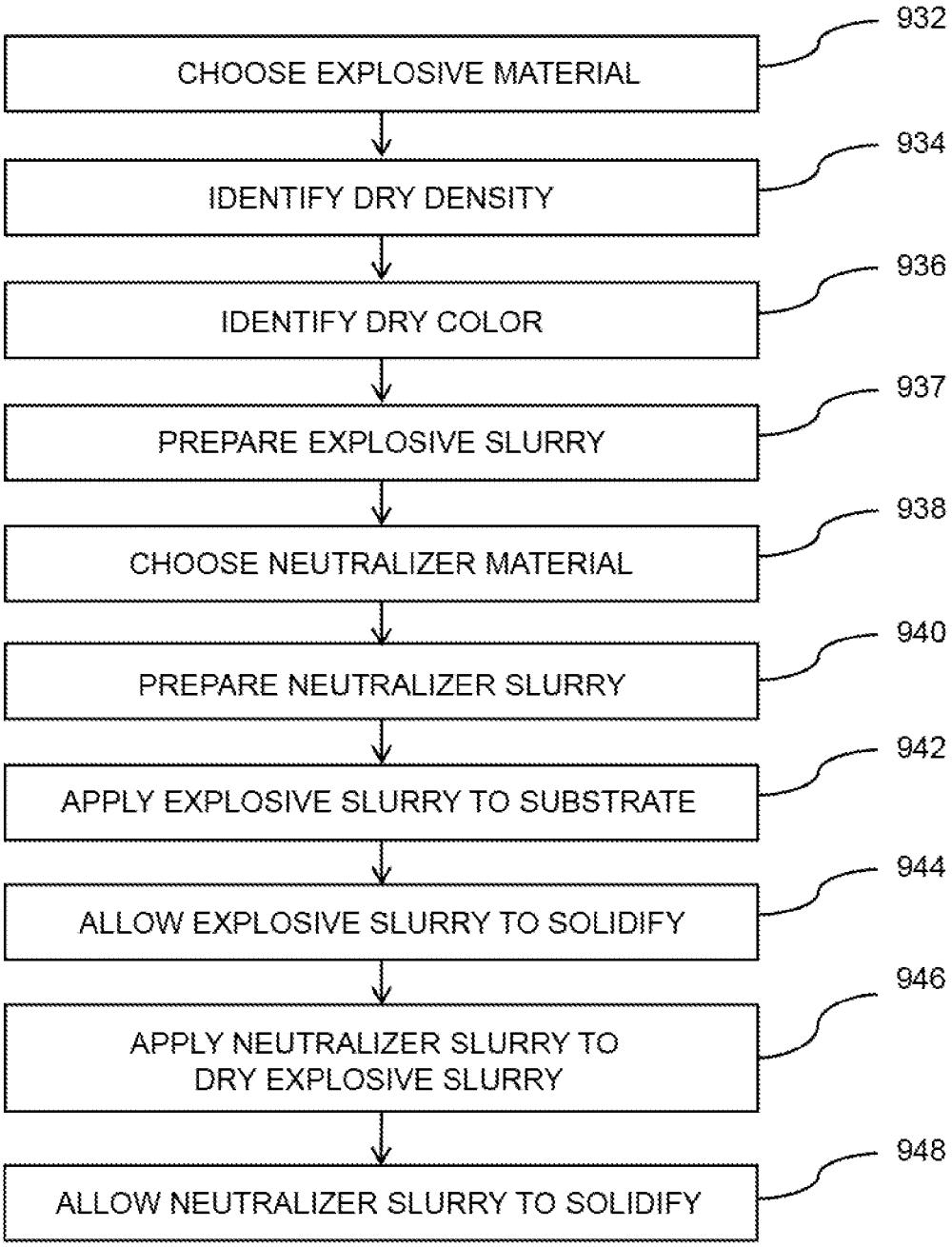
FIG. 9 is a flow chart of steps required with assembly of a preferred embodiment of this disclosure.

Referring to FIG. 9, the steps involved with constructing a preferred device is shown. At step 932, an explosive material is chosen. The proper explosive material will be chosen based on its intended use. At step 934, the dry density of the explosive material is identified. At step 936, the color of the dried explosive material is identified. At step 937, a slurry is prepared from the explosive material and the appropriate solvent or liquid. At step 938, the neutralizer material with the identified dry density is chosen. The neutralizer material is selected from Table 3.

At step 940, a neutralizer slurry is prepared using the neutralizer material, proper pigmentation and solvent. In a preferred embodiment, the neutralizer slurry is an embodiment of neutralizer slurry 124 of FIG. 1B and is prepared by placing all of the ingredients or components of neutralizer slurry into a tank or hopper in which the ingredients or components are mixed.

At step 942, the explosive slurry is applied to the substrate. At step 944, the explosive slurry is allowed to solidify and dry.

At step 946, the neutralizer slurry is applied to the dried explosive slurry and the substrate. In a preferred embodiment, the underside of a tank or hopper, such as tank or hopper 852 of FIG. 8B, in which the neutralizer slurry was prepared includes an outlet, such as outlet 854, controlled by a valve, such as valve 856. The valve can be adjusted to control the volume of the neutralizer slurry dispensed. The valve is placed over the article on which neutralizer slurry 820 is to be applied. For example, the article may comprise substrate 840 and explosive material 830 of FIGS. 8A and 8B. After placement of the valve, the valve is actuated to dispense a selected amount of the neutralizer slurry onto the article to achieve a desired ratio between the amount of neutralizer slurry and the amount of explosive slurry on the article.

At step 948, the neutralizer slurry is allowed to solidify and dry.

Figure 10:
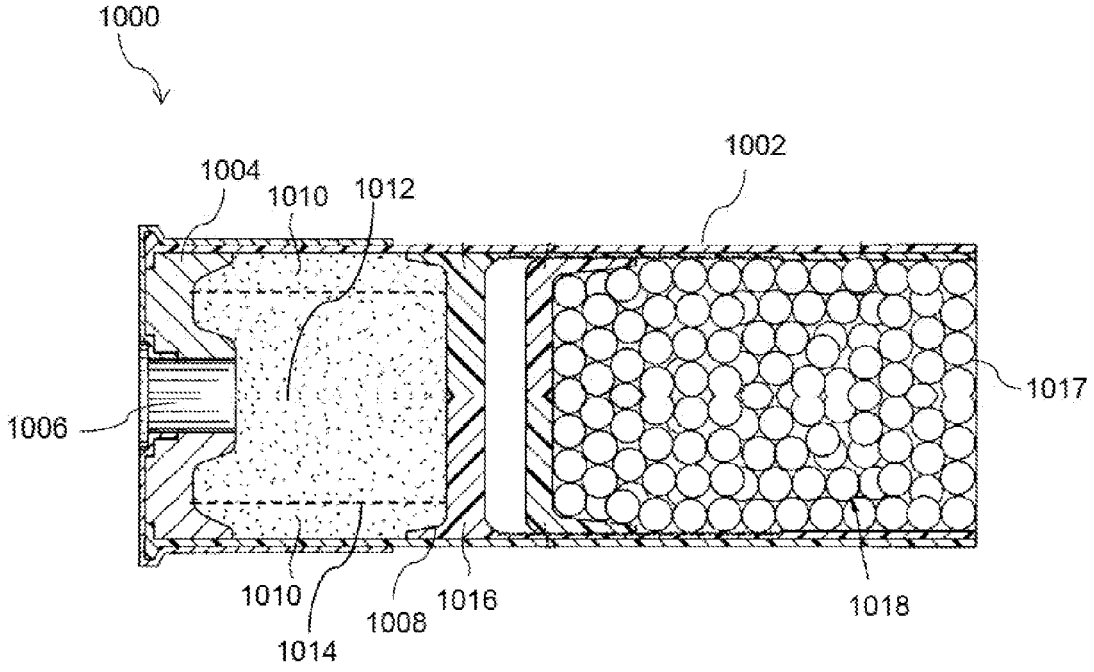
FIG. 10 is a section plan view of an article of manufacture including a preferred embodiment of this disclosure.

In one preferred embodiment, an article of manufacture, in this case a shotgun shell, is produced according to this disclosure. Referring to FIG. 10, an article of manufacture, shotgun shell 1000, is shown. Shotgun shell 1000 includes casing 1002 enclosed on one end by base 1004. Primer 1006 extends through base 1004 and is positioned adjacent generally cylindrically shaped concealed amalgamated device 1008. Concealed amalgamated device 1008 is comprised of neutralizer material 1010 separated from explosive material 1012 by boundary interface 1014. Adjacent the explosive material and neutralizer material is wad 1016. Shot 1018 is shown adjacent wad 1016. Crimped closure 1017 is shown opposite base 1004.

Figure 11:
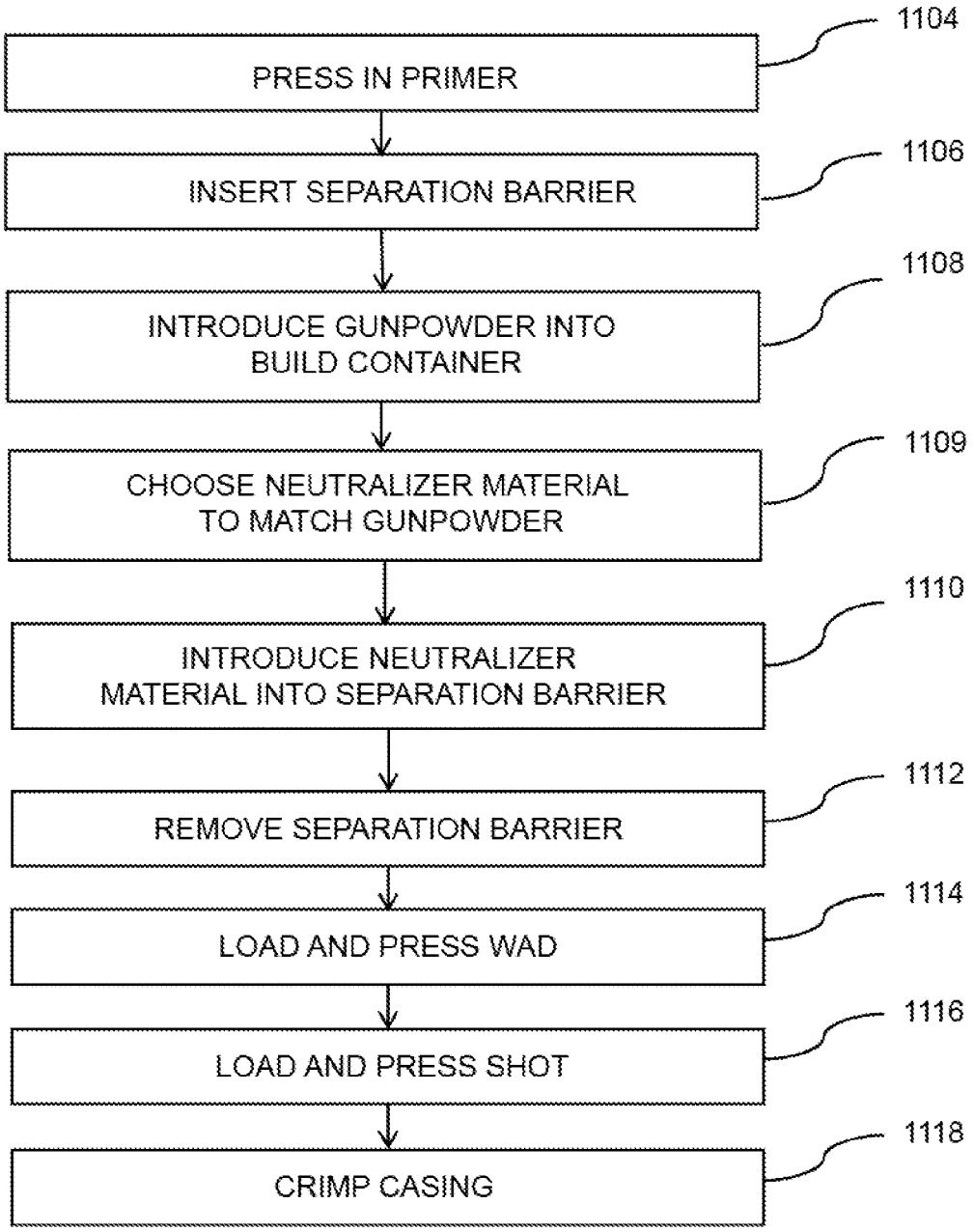
FIG. 11 is a flow chart of steps for assembly of an article of manufacture including a preferred embodiment of this disclosure.

Referring to FIG. 11, a flowchart showing the steps involved in loading a shotgun shell casing incorporating a preferred embodiment of the device. At step 1104, the primer is pressed into the base. A separation barrier in the form of a cylindrical Mylar tube is placed in the casing adjacent the base at step 1106. In a preferred embodiment, the tube is located coaxially with the primer. At step 1108, gunpowder is loaded into the casing within the interior of the separation barrier. At step 1109, the neutralizer material is chosen to match the color and grain size of the gunpowder. Choice of the neutralizer material includes the optional selection of a pigment or dye used to match the color of the neutralizer material to the color of the gunpowder. At step 1110, the neutralizer material is loaded into the casing surrounding the separation barrier. At step 1112, the separation barrier is removed. At step 1114, a wad is loaded and pressed within the casing. At step 1116, shot is loaded and pressed into the casing. At step 1118, the casing is crimped closed.

In use, should the shotgun shell be disassembled, the neutralizer material is automatically and undetectably mixed with the explosive material. Since the neutralizer material cannot be easily separated from the explosive material, the mixture effectively cannot be used to form an improvised explosive device.

Figure 12:
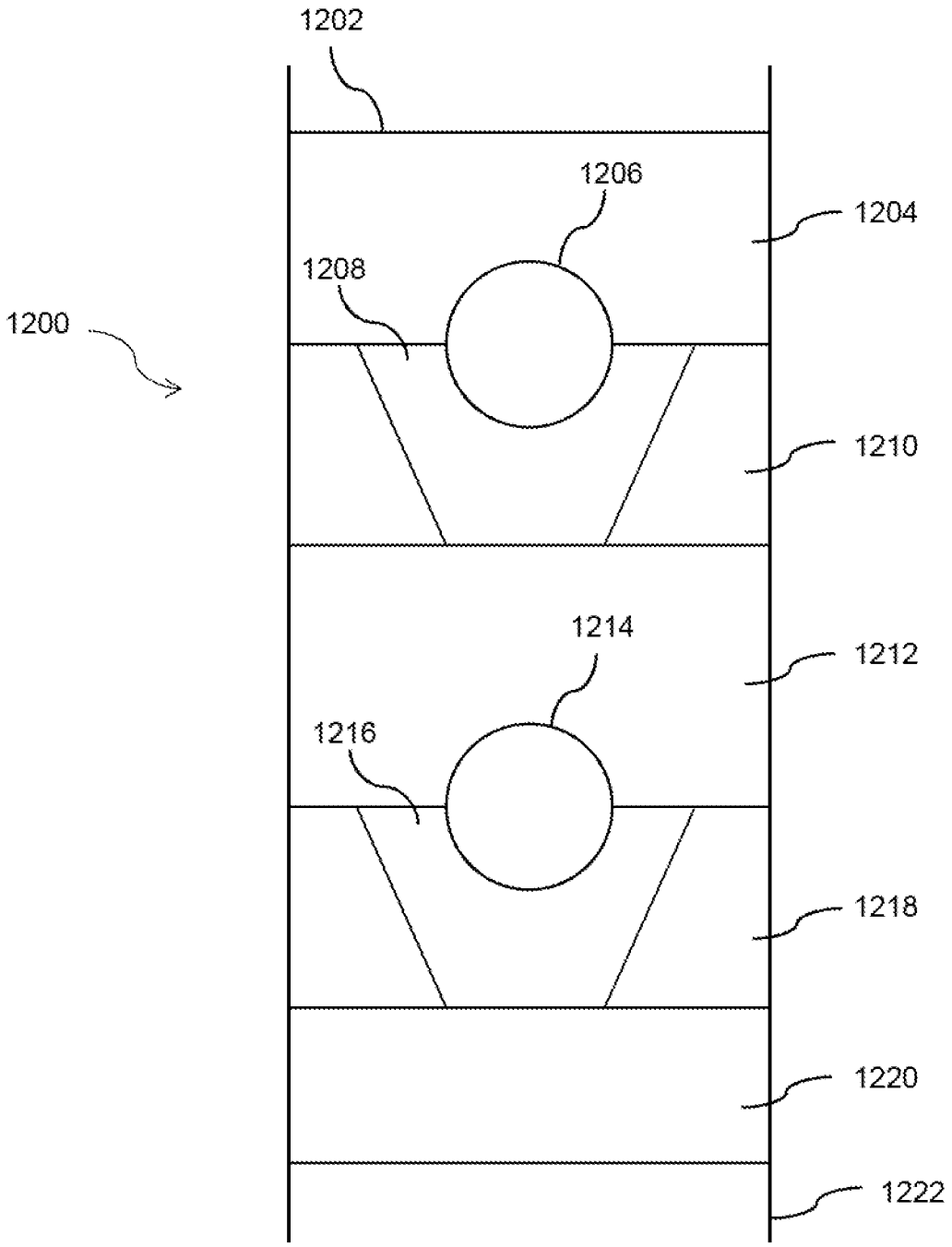
FIG. 12 is a section plan view of a Roman candle in accordance with a preferred embodiment of this disclosure.

In one preferred embodiment, an article of manufacture, in this case a pyrotechnic device commonly referred to as a Roman candle, is produced according to this disclosure. Referring to FIG. 12, an article of manufacture, Roman candle 1200, is shown. Roman candle 1200 includes one or more: fuse 1202, delay charges 1204 and 1212, stars 1206 and 1214, lift charges 1208 and 1216, neutralizer rings 1210 and 1218, clay plug 1220, and paper wrapping 1222.

Fuse 1202 is connected to a first delay charge 1204. Fuse 1202 is a burning fuse that, when lit, burns for a selected amount of time based on the length of fuse 1202 and where fuse 1202 is lit along the length of fuse 1202. Fuse 1202 passes fire to and ignites delay charge 1204.

Delay charge 1204 is connected to fuse 1202 and packed on top of a first star 1206, lifting charge 1208, and shaped neutralizer ring 1210. Delay charge 1204 comprises a pyrotechnic composition that burns at a slow constant rate that is not significantly affected by temperature or pressure and is used to control timing of the pyrotechnic device, i.e., Roman candle 1200. After being ignited by fuse 1202, first delay charge 1204 burns for a selected amount of time based on the composition, height, volume, and density of delay charge 1204, and then ignites one or more of star 1206 and lift charge 1208. Delay charge 1204 delays the time between the burning of fuse 1202 and ignition of star 1206 and lift charge 1208.

Star 1206 is juxtaposed between delay charge 1204 and lift charge 1208. Star 1206 comprises a pyrotechnic composition selected to provide a visual effect, including burning a certain color or creating a spark effect once first star 1206 is ignited. Star 1206 is coated with black powder to aid the ignition of star 1206 and aid the ignition of lift charge 1208.

First lift charge 1208 is juxtaposed between first delay charge 1204 and second delay charge 1212 and is in contact with first star 1206 and first shaped neutralizer ring 1210. First lift charge 1208 comprises an explosive material, such as granulated black powder or any compound selected from Table 5, and is used to shoot first star 1206 out of Roman candle 1200 and to ignite second delay charge 1212. Ignition of first lift charge 1208 causes first star 1206 to shoot out of Roman candle 1200 with a velocity based on one or more of the composition, size, shape, and position of first lift charge 1208 within Roman candle 1200. As depicted in FIG. 12, first lift charge 1208 is shaped substantially as an inverted frustum of a right angle cone with a diameter of the base contacting first delay charge 1204 being larger than a diameter of the base contacting second delay charge 1212. The shape of lift charge 1208 in conjunction with the shape of neutralizer ring 1210 operate to control the blast profile of the explosion created when lift charge 1208 is ignited. The shape of an inverted frustum provides for the explosion created by the ignition of first lift charge 1208 to be directed out through the top of Roman candle 1200 while still allowing for sufficient contact area with second delay charge 1212 to pass fire onto and ignite second delay charge 1212 after first lift charge 1208 is ignited.

Neutralizer ring 1210 surrounds the conically slanted side of lift charge 1208 and is juxtaposed between delay charge 1204 and delay charge 1212. Neutralizer ring 1210 is a ring of material comprising an inert material that, as described above, is indiscernible from the explosive material of lift charge 1208 and that, if mixed with the explosive material of lift charge 1208, results in a composition having a substantially reduced explosiveness. Material of shaped neutralizer ring 1210 has a grain size and color matching that of the grain size and color of material of lift charge 1208 so that the interface between shaped neutralizer ring 1210 and lift charge 1208 is indiscernible.

Delay charge 1212, star 1214, lift charge 1216, and neutralizer ring 1218 operate in a similar fashion as delay charge 1204, star 1206, lift charge 1208, and neutralizer ring 1210, but may have the same or different compositions, sizes, shapes, positions, and geometries and provide for the same or different specific effects.

Clay plug 1220 is a bottom layer of Roman candle 1200 beneath the combination of second lift charge 1216 and neutralizer ring 1218. Clay plug 1220 prevents fire from second lift charge 1216 from escaping through the bottom of Roman candle 1200 and prevents lift charge 1216 from being ignited from below.

Paper wrapping 1222 surrounds the sides of Roman candle 1200 forming a cylindrical shape. Paper wrapping 1222 protects Roman candle 1200 when not in use and acts as a muzzle to direct stars 1206 and 1214 when they are shot out of the top of Roman candle by lift charges 1208 and 1216, respectively.

Figure 13:
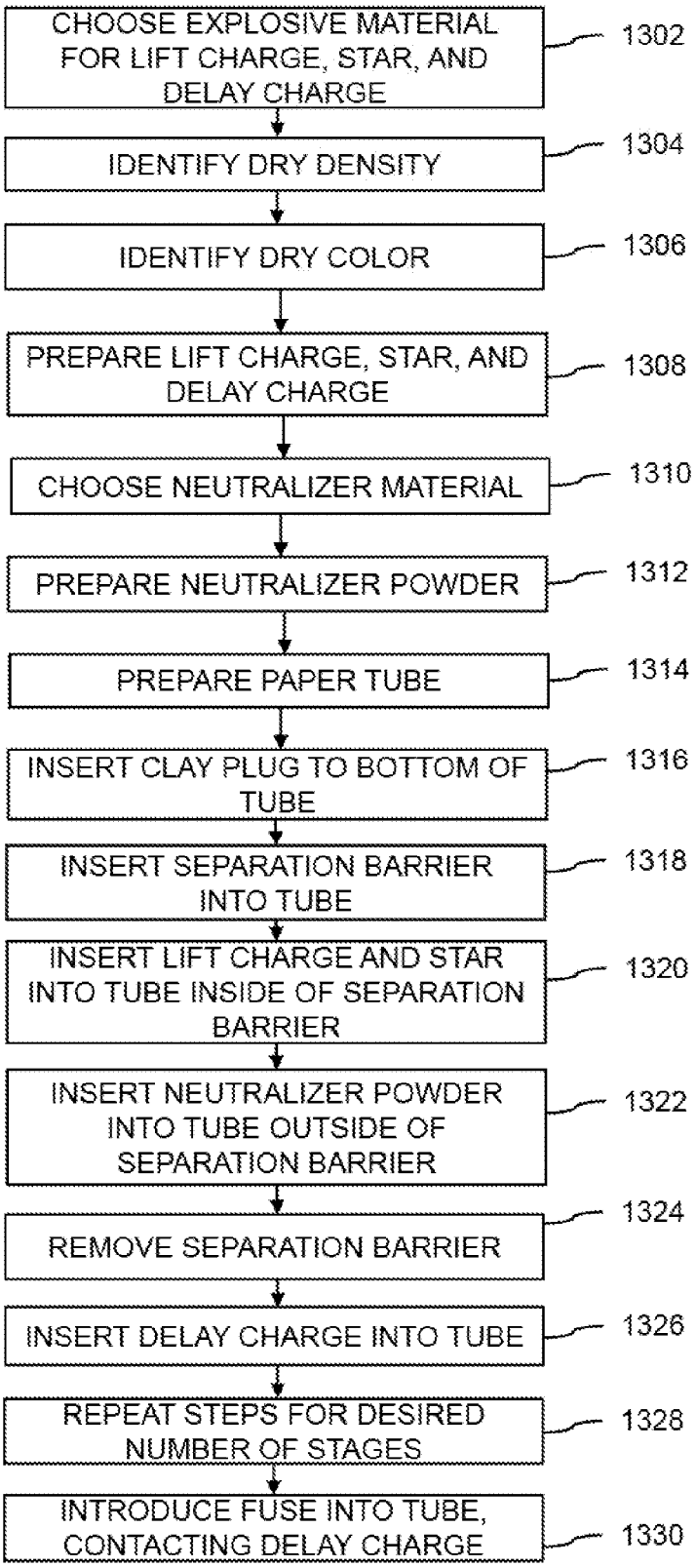
FIG. 13 is a flow chart of steps to build a Roman candle in accordance with a preferred embodiment of this disclosure.

Referring to FIG. 13, one or more steps involved with constructing a pyrotechnic device commonly referred to as a Roman candle is shown. At step 1302, an explosive material is chosen. The proper explosive material will be chosen based on its intended use and may be selected from the explosive compounds from Table 5. At step 1304, the dry density of the explosive material is identified. At step 1306, the color of the dried explosive material is identified. At step 1308, the lift charge, star and delay charge are prepared using explosive material. At step 1310, the neutralizer material with the identified dry density is selected from the neutralizers listed in Table 3. At step 1312, a neutralizer powder is prepared using the neutralizer material and proper pigmentation and solvent selected from Tables 3-4.

At step 1314, a paper tube is prepared to receive the clay plug, one or more lift charges, one or more stars, one or more delay charges and neutralizer powder. The paper tube may be placed vertically so that the materials may be introduced from the top of the tube. At step 1316, a clay plug is inserted into the bottom of tube that directs the explosions from the lift charge out through the top of the tube. At step 1318, a separation barrier is inserted into the tube. The separation barrier may include a slant to be slightly conical in shape so that the lift charge is formed as a frustum. At step 1320, the lift charge is inserted into the tube inside the separation barrier, after which one or more stars are placed on top of the lift charge. At step 1322, neutralizer powder is inserted into the tube outside of the separation barrier. The neutralizer powder has the same grain size and color as the lift charge. At step 1324, the separation barrier is removed and the interface between the lift charge and the neutralizer is indiscernible due to the selected properties of the neutralizer powder. At step 1326, a delay charge is inserted into the tube and packed down so that the lift charge, stars, neutralizer powder, and delay charge will not mix during subsequent handling and processing. At step 1328, steps 1318-1326 are repeated for a desired number of stages for the pyrotechnic device. At step 1330, a fuse is introduced into the tube that contacts the top-most delay charge.

Figure 14:
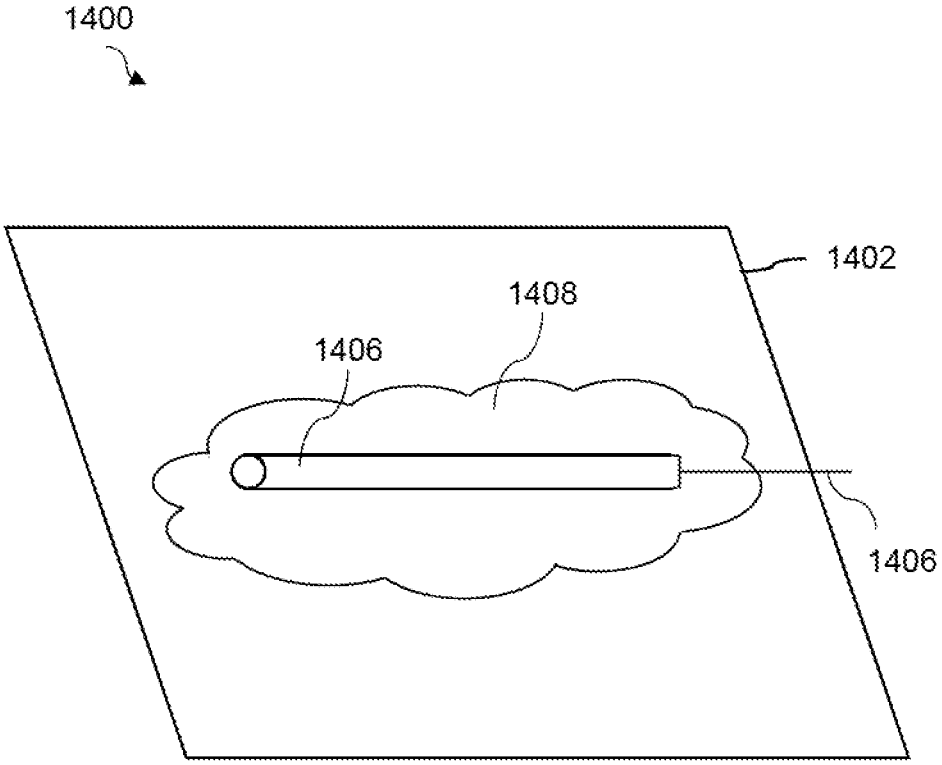
FIG. 14 is an isometric view of a pyrotechnic assembly in accordance with a preferred embodiment of this disclosure.

In one preferred embodiment, an article of manufacture, in this case a pyrotechnic assembly, is produced according to this disclosure. Referring then to FIG. 14, an article of manufacture, pyrotechnic assembly 1400, is shown. Pyrotechnic assembly 1400 includes: paper 1402, slurry 1404, fuse 1406, and solidified material 1408.

Paper 1402 forms an outer shell for a pyrotechnic device created from assembling pyrotechnic assembly 1400. Prior to rolling paper 1402 to form a cylinder, slurry 1404 is placed on paper 1402, solidified material 1408 is placed onto slurry 1404, and fuse 1406 is positioned. After positioning slurry 1404, solidified material 1408, and fuse 1406 onto paper 1402, paper 1402 is rolled to form a cylindrical pyrotechnic device.

Slurry 1404 is positioned on paper 1402 between paper 1402 and solidified material 1408 prior to rolling paper 1402. After rolling, slurry 1404 forms a substantially continuous layer around solidified material 1408. One of slurry 1404 and solidified material 1408 comprises neutralizer material (e.g., concealed amalgamated neutralizer 104 of FIG. 1A) and the other of slurry 1404 and solidified material 1408 comprises explosive material (e.g., explosive composition 114 of FIG. 1A). After solidifying, the boundary between the material of slurry 1404 and the material of solidified material 1408 will be indiscernible upon visual inspection. The volume of slurry 1404 is sufficient so that when the material of slurry 1404 is randomly mixed with the material of solidified material 1408, the explosiveness of the combined mixed material is substantially reduced.

Fuse 1406 is positioned to pass flame to explosive material comprised by one of slurry 1404 and solidified material 1408. Fuse 1406 contacts both slurry 1404 and solidified material 1408 so that fuse 1406 contacts both the inert material of one of slurry 1404 and solidified material 1408 and the explosive material of the other of slurry 1404 and solidified material 1408. By contacting both slurry 1404 and solidified material 1408, the position of fuse 1406 does not provide an indication of whether solidified material 1408 or slurry 1404 comprises explosive material in the final assembled device.

In an alternative embodiment where solidified material 1408 comprises the explosive material, fuse 1406 may be positioned within and incorporated into solidified material 1408 prior to the solidification of solidified material 1408. With fuse 1406 incorporated into solidified material 1408, placement of solidified material 1408 also positions fuse 1406 with respect to paper 1402 of assembly 1400.

Solidified material 1408 is positioned on slurry 1404 prior to rolling paper 1402 and contacts fuse 1406. After rolling pyrotechnic assembly 1400 into a pyrotechnic device, solidified material 1408 is located in substantially the center of the pyrotechnic device. In alternative embodiments, solidified material 1408 may be positioned away from the center of the pyrotechnic device and create a different explosion profile as compared to when the solidified material 1408 is placed in the center of the pyrotechnic device.

Figure 15:
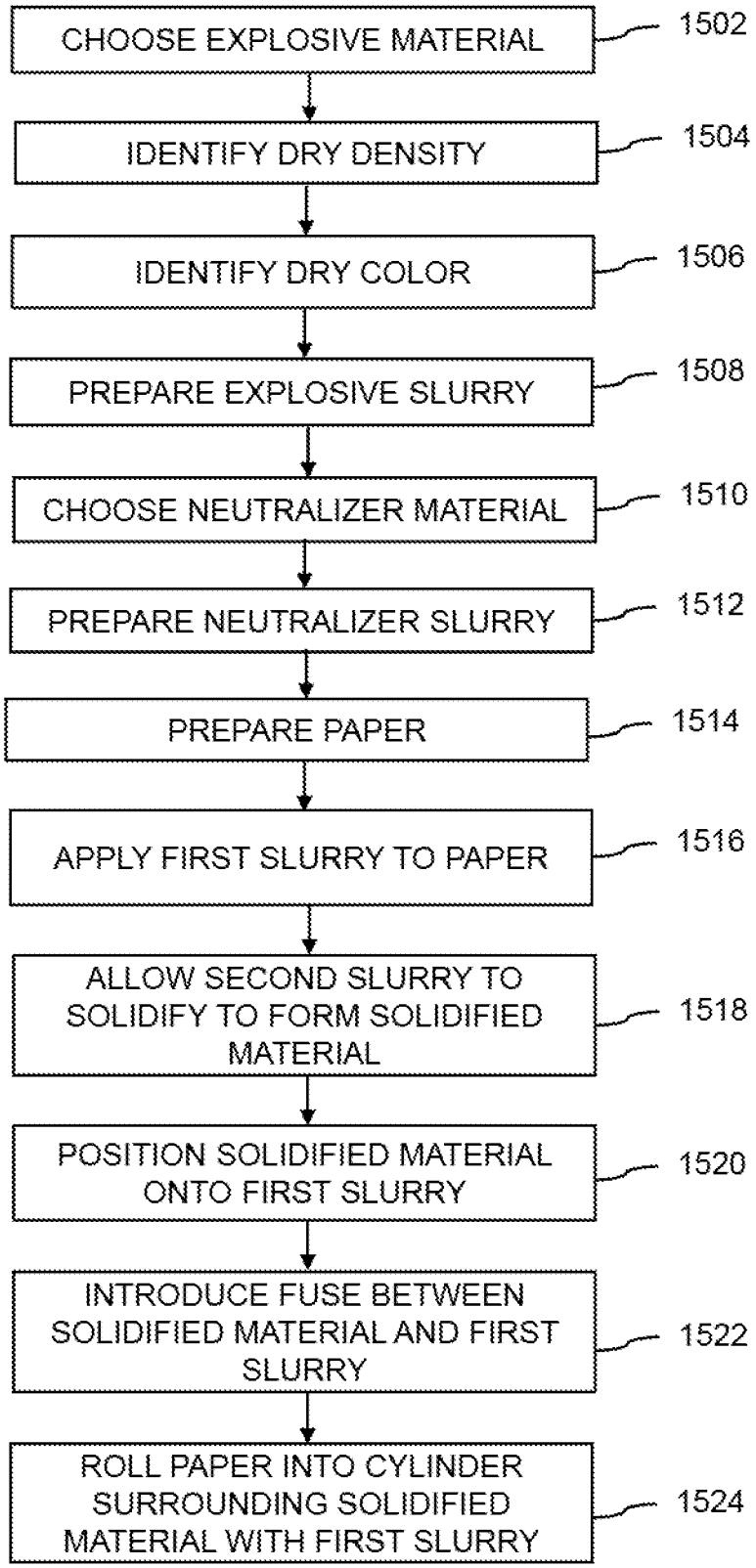
FIG. 15 is a flow chart of steps to build a pyrotechnic assembly in accordance with a preferred embodiment of this disclosure.

Referring to FIG. 15, one or more steps involved with constructing a pyrotechnic device by rolling single portions of explosive material and neutralizer material into a cylinder is shown. At step 1502, an explosive material is chosen from Table 5. The proper explosive material will be chosen based on its intended use. At step 1504, the dry density of the explosive material is identified. At step 1506, the color of the dried explosive material is identified. At step 1508, an explosive slurry is using the explosive material and the appropriate solvent or liquid. At step 1510, the neutralizer material with the identified dry density is chosen. At step 1512, a neutralizer slurry is prepared using the neutralizer material and proper pigmentation and solvent or liquid.

At step 1514, paper is prepared for creating the pyrotechnic device. The paper is formed as a square or rectangular sheet with appropriate dimensions of thickness, length, and width to form the exterior of the pyrotechnic device. At step 1516, a first slurry is applied to the paper. The first slurry is one or the other of the explosive slurry and the neutralizer slurry. At step 1518 and prior to introducing the second slurry to the first slurry, the second slurry is allowed to at least partially solidify to form a solidified material or paste that is thicker than the first slurry to aid further processing steps. The second slurry is different from the first slurry and is the other of the explosive slurry or the neutralizer slurry. At step 1520, the solidified material made from the second slurry is positioned onto the first slurry.

Figure 16:
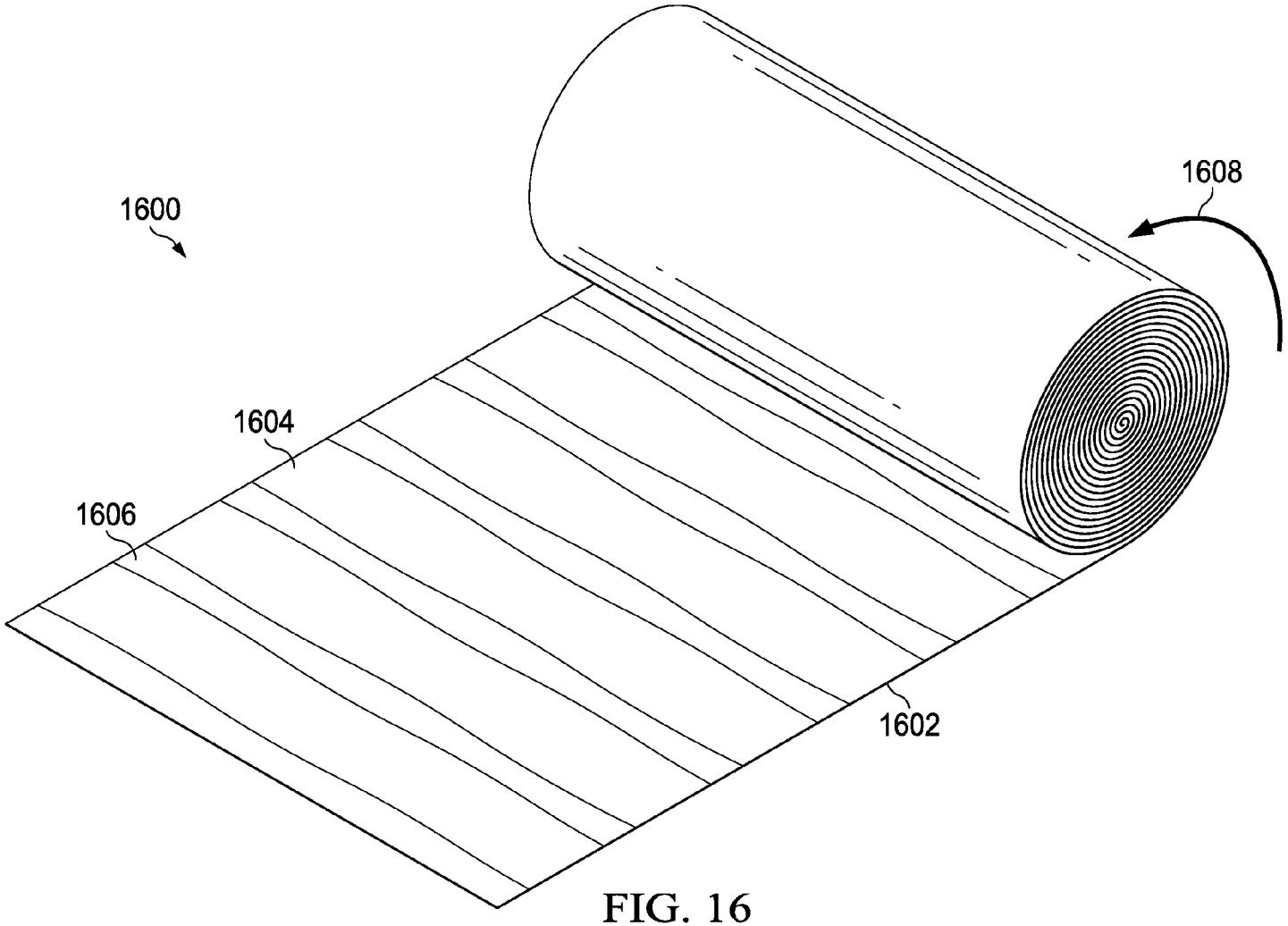
FIG. 16 is an isometric view of a pyrotechnic assembly in accordance with a preferred embodiment of this disclosure.

At step 1522, a fuse is introduced between the solidified material and the first slurry so as to contact the explosive material in one or the other of the first slurry and the second slurry. In alternative embodiments, the fuse is introduced into the second slurry prior to solidification of the second slurry. At step 1524, the paper is rolled into a cylindrical shape. The process or rolling the paper surrounds the entirety of the solidified material with the first slurry and positions the solidified material substantially in the center of the cylinder created by rolling the paper. Positioning the solidified material in the center of the cylinder gives the pyrotechnic device a substantially uniform blast profile along the circumference of the cylinder. In alternative embodiments, the solidified material is positioned off center so that the pyrotechnic device will not contain a substantially uniform blast profile along the circumference of the cylinder In one preferred embodiment, an article of manufacture, in this case a pyrotechnic assembly, is produced according to this disclosure. Referring to FIG. 16, an article of manufacture, assembly 1600, is shown that forms an embodiment of portion 100 of a pyrotechnic device of FIG. 1A. Assembly 1600 includes: paper 1602, explosive compound 1604, and neutralizer compound 1606.

Paper 1602 is a substrate onto which explosive compound 1604 and neutralizer compound 1606 are applied. After application of explosive compound 1604 and neutralizer compound 1606 onto paper 1602, paper 1602 is rolled from one end in direction 1608 to form a cylinder. A fuse for igniting explosive compound 1604 may be introduced to assembly 1600 before or after rolling paper 1602 into a cylinder. After assembly into pyrotechnic device, paper 1602 protects the pyrotechnic device from unwanted ignition.

Explosive compound 1604 is any explosive material and is applied to paper 1602 as a paste or slurry to stick between multiple layers of paper 1602 after paper 1602 is rolled. The width of each portion of explosive compound 1604 applied to paper 1602 is substantially uniform. In alternative embodiments, the width of each portion of explosive compound 1604 applied to paper 1602 may vary along the length of paper 1602. The overall ratio of the volume of explosive compound 1604 to the volume of neutralizer compound 1606 is such that, if explosive compound 1604 and neutralizer compound 1606 are removed from a pyrotechnic device created from assembly 1600 and mixed, then the resulting mixture would have a substantially reduced explosive effectiveness.

Neutralizer compound 1606 is any neutralizer material and is also applied to paper 1602 as a paste or slurry to stick between multiple layers of paper 1602 after paper 1602 is rolled. The width of each portion of neutralizer compound 1606 applied to paper 1602 is substantially uniform and is less than the width of the portions of explosive compound 1604. When dried, neutralizer compound 1606 has a grain size that substantially matches the grain size of explosive compound 1604. Neutralizer compound 1606 includes pigmentation so that the color of neutralizer compound 1606 substantially matches the color of explosive compound 1604. The boundary interface between the portions of explosive compound 1604 and neutralizer compound 1606 are indiscernible upon final assembly due to the matching grain size and color between explosive compound 1604 and neutralizer compound 1606.

In alternative embodiments, the width of each portion of explosive compound 1604 applied to paper 1602 may vary along the length of paper 1602.

Figure 17:
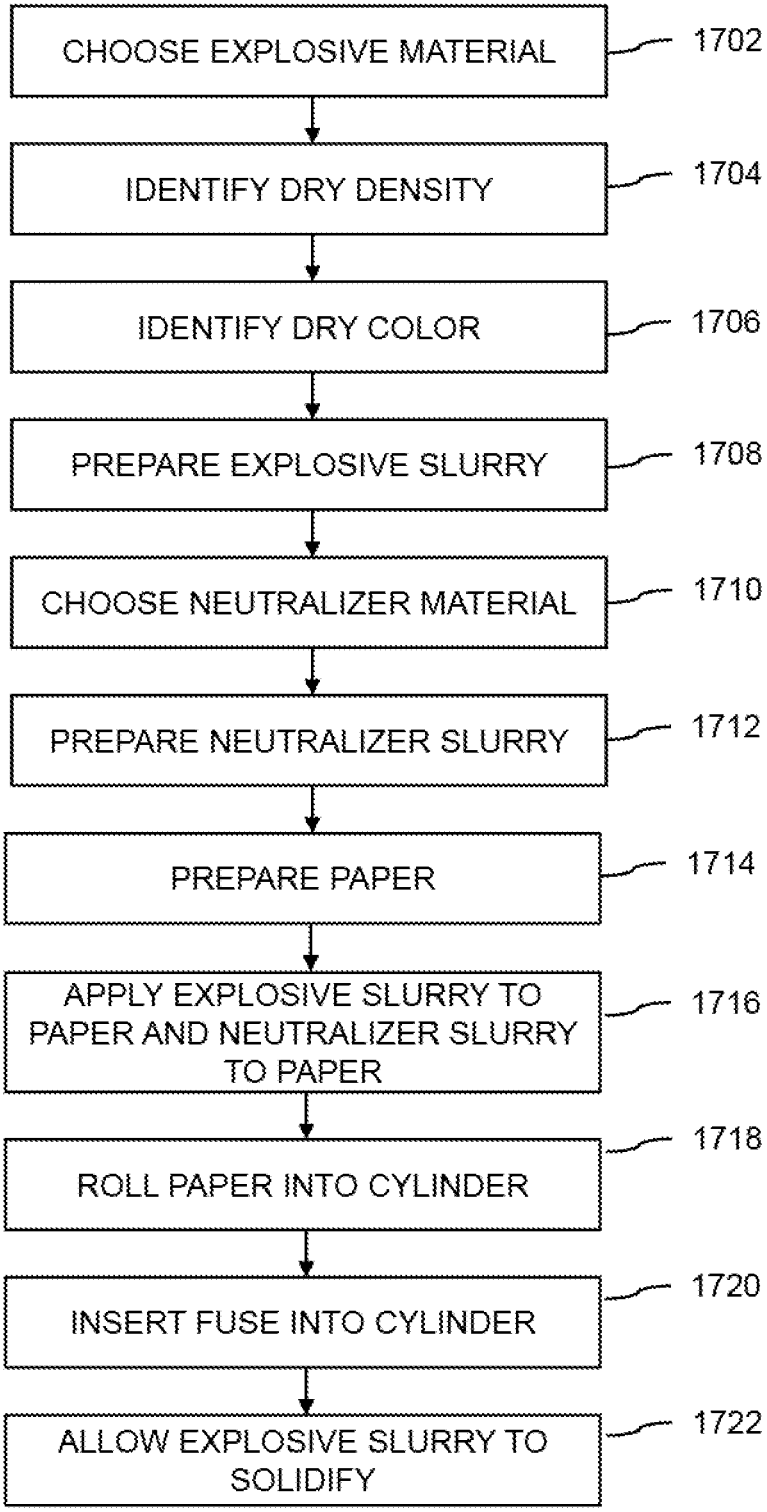
FIG. 17 is a flow chart of steps to roll a pyrotechnic device in accordance with a preferred embodiment of this disclosure.

Referring to FIG. 17, one or more steps involved with constructing a pyrotechnic device by rolling multiple portions of explosive material and neutralizer material is shown. At step 1702, an explosive material is chosen from Table 5. The proper explosive material will be chosen based on its intended use. At step 1704, the dry density of the explosive material is identified. At step 1706, the color of the dried explosive material is identified. At step 1708, a slurry is prepared from the explosive material and the appropriate solvent or liquid. At step 1710, the neutralizer material with the identified dry density is chosen. At step 1712, a neutralizer slurry is prepared using the neutralizer material and proper pigmentation and solvent.

At step 1714, paper is prepared as a substrate to receive the explosive slurry and neutralizer slurry. The paper is sliced into a selected length and width suitable for rolling. At step 1716, explosive slurry and neutralizer slurry are applied to the paper in alternating portions, as shown in FIG. 16. The width of the portions may be uniform or vary based on the location of the portion with respect to the leading edge of the paper that gets rolled first and the trailing edge of the paper that gets rolled last. For example, portions closer to the trailing edge may have a longer width as compared to portions closer to the leading edge At step 1718, the paper with the applied explosive slurry and neutralizer slurry is rolled into a cylindrical shape so that each portion of explosive compound contacts two portions of neutralizer compound and two layers of paper. Similarly, each portion of neutralizer compound contacts two portions of explosive compound and two layers of paper.

At step 1720, a fuse is inserted into the cylinder created by rolling the paper. The fuse is inserted so as to contact at least one portion of explosive slurry. At step 1722, at least the explosive slurry is allowed to solidify and optionally the neutralizer is also allowed to solidify.

At step 1720, the explosive slurry is allowed to solidify as well as the neutralizer slurry. The cylindrically shaped roll comprising the solidified explosive slurry and the neutralizer slurry may then be used to form a pyrotechnical device. With the color, grain size, and dry density being substantially similar, the interfaces between portions of explosive material and neutralizer material in the rolled cylinder are indiscernible upon visual inspection and the explosive material is indistinguishable from the neutralizer material. Removal of the explosive material would also remove the neutralizer material so that attempted use of the explosive material in an improvised explosive device would mix the explosive material with the neutralizer material and reduce the effectiveness of the explosive material in the improvised explosive device.

Figure 18:
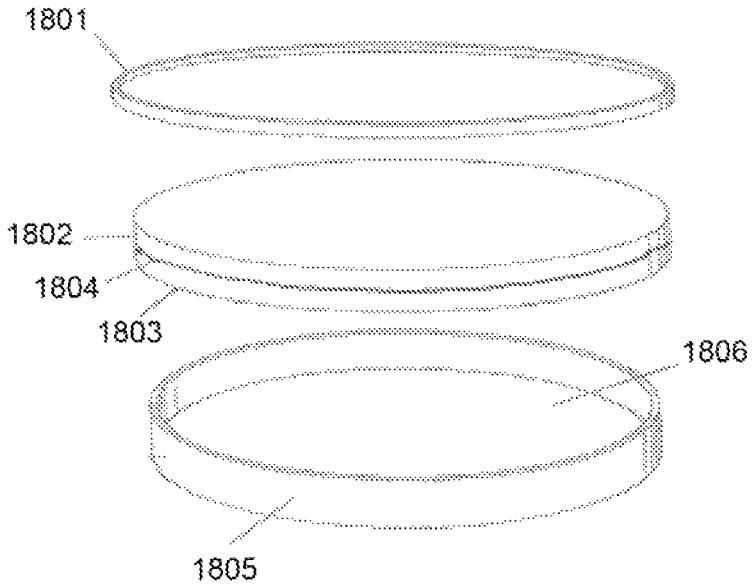
FIG. 18 is a detail view of a pyrotechnic device in accordance with a preferred embodiment of this disclosure.

In one preferred embodiment, an article of manufacture, in this case pyrotechnic device 1800 forms, for example, an instant hit recognition flare or pyrotechnic target, and is produced according to this disclosure. Referring to FIG. 18, an article of manufacture, pyrotechnic device 1800, is shown that forms an embodiment of portion 100 of a pyrotechnic device of FIG. 1A. Pyrotechnic device 1800 includes: cardboard lid 1801, concealed amalgamated neutralizer 1802, pyrotechnic composition 1803, imperceptible boundary layer 1804, and shell case 1805.

Cardboard lid 1801 and shell case 1805 form an embodiment of housing 102 of FIG. 1A. Cardboard lid 1801 is fitted to the top of shell case 1805 and presses against concealed amalgamated neutralizer 1802 to compact and maintain the shape and position of concealed amalgamated neutralizer 1802 and pyrotechnic composition 1803 within pyrotechnic device 1800.

Concealed amalgamated neutralizer 1802 is layered on top of pyrotechnic composition 1803 and is held in place by cardboard lid 1801 and shell casing 1805. Pyrotechnic composition 1803 is an embodiment of explosive composition 114, is layered on top of shell case floor 1806, and is held in place by shell casing 1805. When concealed amalgamated neutralizer 1802 is mixed with pyrotechnic composition 1803 outside of pyrotechnic device 1800, such as in an improvised explosive device, the explosive power of the resulting mixture is reduced as compared to the explosive power of pyrotechnic composition 1803.

Imperceptible boundary layer 1804 is present at the interface or junction between concealed amalgamated neutralizer 1802 and pyrotechnic composition 1803. Concealed amalgamated neutralizer 1802 is selected, processed, and manufactured to comprise a grain shape, grain size, color, and density that substantially matches the grain shape, grain size, color, and density of pyrotechnic composition 1803 so that imperceptible boundary layer 1804 cannot be perceived upon visual inspection.

Shell case 1805 comprises shell case floor 1806 and contains concealed amalgamated neutralizer 1802 and pyrotechnic composition 1803. Shell case 1805 presses against concealed amalgamated neutralizer 1802 and pyrotechnic composition 1803 to compact and maintain the shape and position of concealed amalgamated neutralizer 1802 and pyrotechnic composition 1803 within pyrotechnic device 1800.

Figure 19:
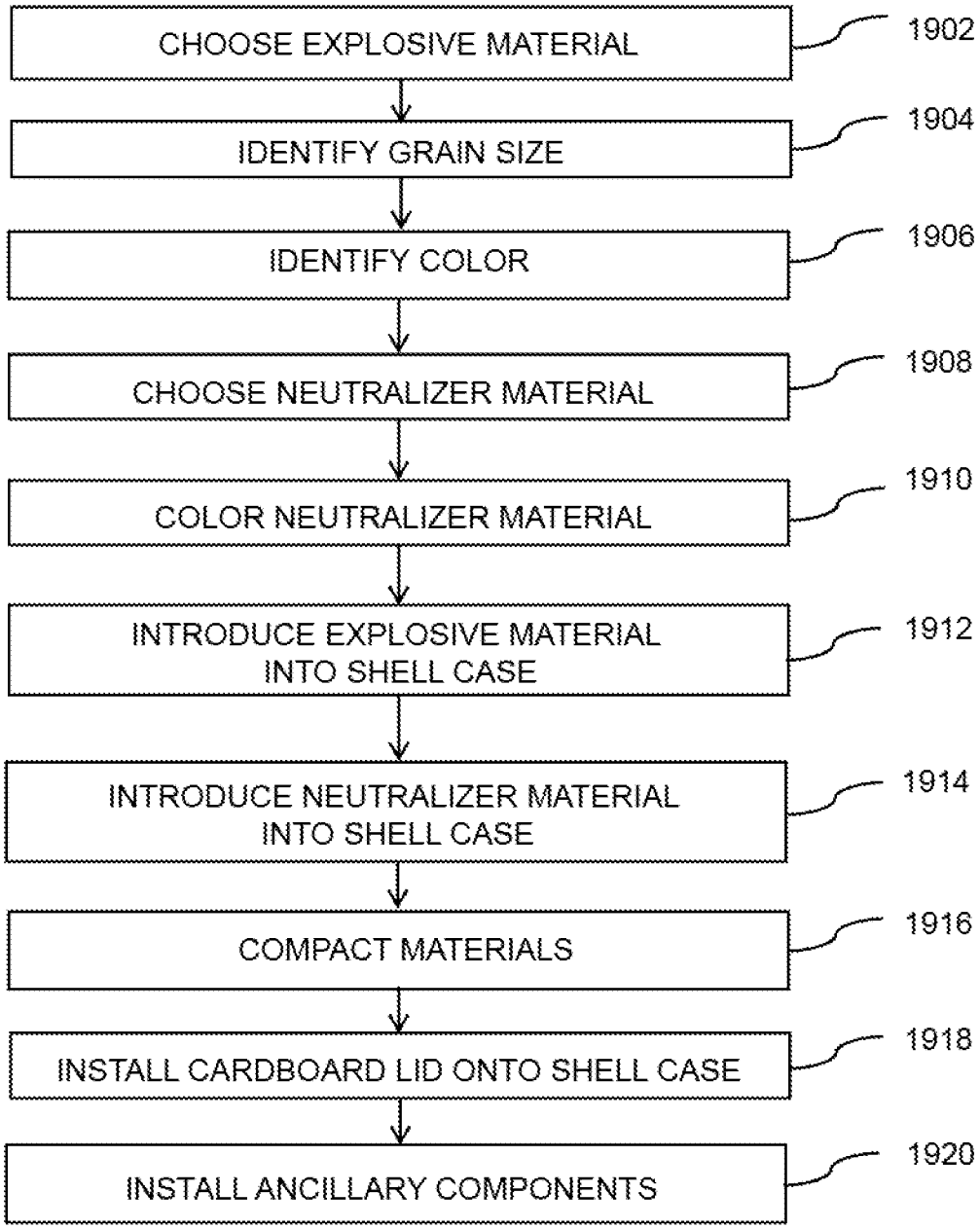
FIG. 19 is a flow chart of steps to build a device using a shell case in accordance with a preferred embodiment of this disclosure.

Referring to FIG. 19, the steps involved with constructing a pyrotechnic device with concealed amalgamated neutralizer as used in an instant hit recognition flare or pyrotechnic target using a shell case is shown. At step 1902, an explosive material, also known as a pyrotechnic composition, is chosen. The proper explosive material will be chosen based on its intended use. At step 1904 the grain size of the explosive material is identified. If the explosive material contains multiple components each having different grains sizes, each grain size will be identified. At step 1906, the color of the explosive material is identified. At step 1908, a matching neutralizer material, also known as a concealed amalgamated neutralizer or a concealed amalgamated neutralizer component, with the identified grain size is chosen. The neutralizer material and the level of neutralization desired is chosen according to Table 1 for dry materials or Table 2 for slurries. At step 1910, if the color of the neutralizer material does not match the explosive material, then the neutralizer material is colored to match the explosive material using one or more pigments or dyes. In a different embodiment, a charcoal dye is employed to tint the neutralizer material. At step 1912, the explosive material is introduced into a shell case. At step 1914, the neutralizer material is introduced into the shell case, and if necessary, the shell case is assembled. If necessary, at step 1916, the materials introduced in the build container are compacted. At step 1918, a cardboard lid is installed onto and fitted to the shell case. In alternative embodiments, the materials are compacted after installation of the cardboard lid instead of or in addition to being compacted prior to installation of the cardboard lid. At step 1920, any ancillary components required for the device, such as plugs, primers, fuses, detonators, etc., are installed.

It will be appreciated by those skilled in the art that modifications can be made to the embodiments disclosed and remain within the inventive concept. Therefore, this invention is not limited to the specific embodiments disclosed, but is intended to cover changes within the scope and spirit of the claims.

The invention claimed is:

1. A pyrotechnic device comprising:

a homogenous explosive material having a first set of properties consisting of a first color, a first grain size, and a first density;

a homogenous neutralizer material, having a second set of properties consisting of a second color, a second grain size, and a second density, adjacent the homogenous explosive material;

a boundary surface between the homogenous explosive material and the homogenous neutralizer material within the pyrotechnic device;

wherein the first color is indiscernible from the second color by unassisted human vision;

wherein the first grain size is indiscernible from the second grain size by unassisted human vision; and, wherein the first density is indiscernible from the second density by unassisted human vision.

2. The pyrotechnic device of claim 1 wherein a ratio of a first weight of the homogenous explosive material to a second weight of the homogenous neutralizer material is sufficient to reduce an explosiveness of the homogenous explosive material when the homogenous neutralizer material is mixed with the homogenous explosive material.

3. The pyrotechnic device of claim 2 wherein the homogenous explosive material maintains explosiveness while contained within the pyrotechnic device.

4. The pyrotechnic device of claim 2:

wherein the pyrotechnic device is a target.

5. The pyrotechnic device of claim 1:

wherein the homogenous explosive material comprises about 70% potassium chlorate and about 30% aluminum by weight; and, wherein the homogenous neutralizer material comprises about 65% magnesium silicate, about 30% aluminum, and about 5% ackroyd resin by weight.

6. The pyrotechnic device of claim 1 wherein a ratio of the homogenous explosive material to the homogenous neutralizer material is about 3:2 by weight.

* * * * *